US010362827B2

(12) United States Patent
Bryan et al.

(10) Patent No.: US 10,362,827 B2
(45) **Date of Patent: *Jul. 30, 2019**

(54) HEADGEAR ACCESSORY ATTACHMENT APPARATUS

(71) Applicant: Bryan Family Enterprises LLC, Union City, CA (US)

(72) Inventors: Teresa A. Bryan, Union City, CA (US); John E. Bryan, Union City, CA (US)

(73) Assignee: Bryan Family Enterprises LLP, Union City, CA (US)

( * ) Notice: Subject to any disclaimer, the term of this patent is extended or adjusted under 35 U.S.C. 154(b) by 313 days.

This patent is subject to a terminal disclaimer.

(21) Appl. No.: 15/266,508

(22) Filed: Sep. 15, 2016

(65) Prior Publication Data

US 2017/0027265 A1 Feb. 2, 2017

Related U.S. Application Data

(63) Continuation of application No. 14/366,243, filed as application No. PCT/US2012/070496 on Dec. 19, 2012, now Pat. No. 9,451,801.

(Continued)

(51) Int. Cl.
*A42B 3/22* (2006.01)
*A42B 3/04* (2006.01)

(Continued)

(52) U.S. Cl.
CPC ..... *A42B 3/0406* (2013.01); *A42B 3/04* (2013.01); *A42B 3/042* (2013.01); *A42B 3/044* (2013.01);

(Continued)

(58) Field of Classification Search
CPC ..... A42B 3/228; A42B 1/02; A42C 5/04
See application file for complete search history.

(56) References Cited

U.S. PATENT DOCUMENTS 1,030,173 A * 6/1912 Haggerty ..... A42B 1/208 2/12
1,238,615 A * 8/1917 Wolf ..... A42B 1/02 2/175.5

(Continued)

OTHER PUBLICATIONS

PCT International Search Report and Written Opinion of the International Searching Authority, dated Sep. 28, 2012application No. PCT/US2012/025788.

*Primary Examiner* — Tajash D Patel
*Assistant Examiner* — Tejash Patel
(74) *Attorney, Agent, or Firm* — Richard Batt

(57) ABSTRACT

A headgear accessory attachment apparatus includes a band having an adjustable size for fitting about a circumference of various outdoor sports helmets such as bicycle, skateboarding, snow sport, mountaineering, equestrian helmets, military helmets, and hard hats used in material moving, dock loading, and airport baggage handling. The accessory attachment apparatus provides the wearer an easy means to attach headgear accessories such as headlamps, helmet cameras, rear lights, goggles, visors, brims, and decorative embellishments to the helmet. The accessories may be permanently or temporarily secured to the accessory apparatus. In one headgear accessory attachment apparatus, the band includes a stop surface that opposes a bottom surface of the headgear when the apparatus is affixed to the headgear such that the apparatus is prevented from becoming dislodged during use.

13 Claims, 17 Drawing Sheets

Related U.S. Application Data

(60) Provisional application No. 61/578,218, filed on Dec. 20, 2011, provisional application No. 61/699,723, filed on Sep. 11, 2012.

(51) Int. Cl.
*A42B 3/18* (2006.01)
*A63B 71/10* (2006.01)

(52) U.S. Cl.
CPC ..... *A42B 3/18* (2013.01); *A42B 3/185* (2013.01); *A42B 3/221* (2013.01); *A63B 71/10* (2013.01)

(56) References Cited

U.S. PATENT DOCUMENTS

D136,471 S 10/1943 Wulsin
2,845,289 A * 7/1958 Cicogna ..... A42B 1/201 2/175.2
D246,681 S 12/1977 Hursh
4,316,289 A * 2/1982 Hild ..... A42B 3/32 2/10
4,776,042 A * 10/1988 Hanson ..... A42B 1/008 2/171
5,341,516 A * 8/1994 Keim ..... A42B 3/185 2/424
5,519,895 A * 5/1996 Barnes, Jr. ..... A42B 1/08 2/422
D385,091 S 10/1997 Rodgers
5,727,250 A * 3/1998 Black ..... A42B 3/227 2/10
5,862,520 A * 1/1999 Wyant ..... A42B 1/02 2/10
5,937,439 A * 8/1999 Barthold ..... A42B 3/04 2/10
6,070,270 A * 6/2000 De La Torre ..... A42B 1/064 2/10
6,260,204 B1 * 7/2001 Morrissey ..... A42B 3/003 2/172
6,263,508 B1 * 7/2001 Davis ..... A42B 1/064 2/10
6,308,336 B1 * 10/2001 Stephenson ..... A42B 1/062 2/10
6,311,332 B1 * 11/2001 Lien ..... A42B 1/248 2/175.1
6,374,423 B1 * 4/2002 Anderson ..... A42B 3/227 2/12
6,484,323 B1 * 11/2002 Pu ..... A42B 1/201 2/10
6,694,525 B1 * 2/2004 Murnan ..... A42B 1/064 2/12
6,889,391 B1 * 5/2005 Hitchins ..... A42B 3/16 2/12
6,966,074 B2 * 11/2005 Huh ..... A42B 3/14 2/181.4
D524,517 S 7/2006 Javits, Jr.
D525,015 S 7/2006 Iwata
D525,413 S 7/2006 Javits, Jr.
7,406,721 B2 * 8/2008 Husbands ..... A42B 3/22 2/172
D593,732 S 6/2009 Tilley et al.
7,690,052 B2 * 4/2010 Saladino ..... G02C 5/008 2/10
D617,539 S 6/2010 Boles
D638,585 S 5/2011 Brown
8,042,198 B1 * 10/2011 Cleveland ..... A63B 71/10 2/171
8,819,867 B1 * 9/2014 Boada ..... A42B 1/24 2/171
9,060,558 B2 * 6/2015 Dorman ..... A42B 3/0406
9,451,801 B2 * 9/2016 Bryan ..... A42B 3/04
2002/0004946 A1 * 1/2002 Nelson ..... A42B 3/003 2/175.3
2004/0010832 A1 * 1/2004 Witkoff ..... A42B 3/0433 2/12
2011/0167544 A1 * 7/2011 Kim ..... A42B 3/227 2/421

* cited by examiner

HEADGEAR ACCESSORY ATTACHMENT APPARATUS

CROSS REFERENCE TO RELATED APPLICATIONS

This application is a continuation application of U.S. application Ser. No. 14/366,243, filed Jun. 17, 2014, which is a national phase filing under 35 U.S.C. Section 371 of International Patent Application No. PCT/US2012/070496, filed Dec. 19, 2012, which claims the benefit of U.S. Application No. 61/578,218, filed Dec. 20, 2011; and to U.S. Application No. 61/699,723, filed Sep. 11, 2012 and is related to U.S. application Ser. No. 29/430,311, filed Aug. 23, 2012; all of which are assigned to the Assignee and incorporated herein by reference.

FIELD OF THE INVENTION

The present invention relates to an apparatus for removably attaching accessories to the protective headgear such as outdoor sports helmets, hard hats, and military helmets.

BACKGROUND OF THE INVENTION

Certain headgear, such as various helmets and hard hats, may be used with accessories, such as, for example, a headlamp or brim. Typically, the headlamp includes an elastic band which is placed over the helmet and grips the circumference of the helmet.

The elastic bands, however, are prone to unintentionally detach from the helmet. This problem arises because of the odd shapes of the helmets. Odd shapes of bicycle helmets make it difficult to use the elastic bands of the headlamps to securely attach the accessory to the helmet. The bands slide off. Additionally, a number of outdoor sports helmets are tapered which makes it nearly impossible to use the elastic bands of headlamps. The elastic constricts and unintentionally pops off.

Clips are one alternative to elastic bands. A few hard hats or helmets for military use mountaineering, skiing, and snowboarding have clips pre-integrated into the helmet that secure the helmet to the headlamp. However, most skateboarding, bicycling, paddling, rollerblading, equestrian, and similar sports do not have a pre-integrated clip system for attaching a headlamp strap. The clips are generally hard, sometimes with sharp edges, and pose a safety hazard if they become dislodged in a crash. Additionally, clips may require drilling holes in the helmet to accommodate their attachment.

Adhesives are another alternative. However, the chemicals in the adhesives have the potential to damage the integrity of the headgear, compromising safety. This is undesirable.

Outdoor sports are performed at many times of the day and night and require different accessories. A visor or brim may be used during the daytime and a headlamp and rear light may be used at night. This requires the wearer of the helmet to change out accessories over the course of a day. Current clips for accessories are specific to each accessory, requiring the user to bring multiple sets of hardware when accessories are changed.

Many outdoor sports enthusiasts participate in multiple sports and have helmets specifically designed for each sport. Having multiple helmets requires the purchase and use of multiple accessory attachment receptacles that are adhered to each helmet, which is highly inconvenient and bulky.

Headgear accessories and their attachment devices are often subjected to strong forces. A snowboarder or cyclist, for example, travels at high speeds and consequently subjects his helmet and accessories to large winds that could dislodge the accessory.

A number of accessory attachment devices seek to attach the accessory to headgear, including U.S. Pat. Nos. 4,224,694; 6,009,561; 7,636,954 B2; and U.S. Patent Publication Nos. 2009/0038056; 2009/0077721; 2010/0325784, each of which is incorporated by reference in its entirety. However, these tend to suffer from the shortcomings described above.

Accordingly, there is a need for an apparatus that addresses the above mentioned challenges and that easily and securely mounts accessories to protective headgear without the use of glues or directly mounted clips. There is also a need for an apparatus that provides an easy way to interchange headgear accessories. There is a need for an apparatus that can attach to, and operate with, various headgear to provide the wearer with desired accessories despite the speed and conditions arising from the environment or sport.

SUMMARY OF THE INVENTION

An accessory attachment apparatus for attaching to a sports helmet comprises an adjustably-sized band member for fitting about the circumference of the sports helmet. The accessory attachment apparatus also includes an accessory connector disposed on the band member for mounting a headgear accessory such as, for example, a headlamp, headphones, ear muffs, ear plug, camera, mirror, or brim to the band member. The accessory attachment apparatus also includes a stop disposed on a lower region of the band member. The stop is engagable with the lower surface of the helmet thereby preventing the apparatus from rising upwards on the helmet.

In another embodiment an accessory attachment apparatus for attaching to headgear comprises a band member comprising an upper section, a lower section, and a middle section. The band member has an adjustably sized opening for detachably fitting about the circumference of the headgear. The headgear may be a sports or work helmet. In one embodiment the headgear is a bike helmet.

In another embodiment, a band member has a first or resting configuration when not detachably fit to the headgear, and a second active configuration different than the resting configuration when the band member is detachably fit to the headgear. A bottom section of the band member is flexible, conforming, and floppy when in the resting state. In contrast, when the band member is in the second or active state, and the band member is securely fitted to the headgear, a clamping or lower stop surface is formed which cooperates with the band member to engage a lower surface of the headgear, thereby preventing the apparatus from rising upwards on the headgear.

The accessory attachment apparatus also includes at least one accessory connector disposed on the middle section of the band member for mounting a headgear accessory to the band member.

The accessory attachment apparatus also includes a clamping surface disposed on the bottom section of the band member when the band is actively engaged with the headgear. The clamping surface engages the lower surface of the headgear thereby preventing the apparatus from rising or rotating upwards on the headgear.

In another embodiment the clamping surface is located in the front of the band. The clamping surface engages the lower surface of the front of the headgear.

In another embodiment the apparatus comprises an upper band size adjustment member to adjust the diameter of the band to securely fit the headgear.

In another embodiment the apparatus comprises a bottom band size adjustment member to adjust the diameter of the band to securely fit the headgear in addition to the upper band size adjustment member.

In another embodiment the size adjustment member is a rope.

In another embodiment the apparatus comprises a primary size adjustment member to adjust the size of the band to securely fit about the circumference of the headgear. However, in embodiments the apparatus may have an upper size adjustment member, a lower size adjustment member, a primary size adjustment member, or any combination thereof.

In another embodiment the apparatus comprises an inner section of anti-slip material.

In another embodiment the apparatus comprises a pocket for receiving a visor integrated with the headgear.

In another embodiment the apparatus comprises a frontal reinforcing flap for further securing the apparatus to the headgear and for preventing upward rotation of the apparatus.

In another embodiment the accessory connector operates by snap fit. In another embodiment the connector is a clip having a recess for receiving a plug portion. The plug is secured to the accessory.

In another embodiment the headgear accessory apparatus is a decorative embellishment. The decorative embellishment is a pin in one embodiment. In another embodiment the decorative embellishment is a ribbon.

In another embodiment a headgear system comprises a headgear and a headgear accessory attachment device adapted to detachably fit on the exterior of the headgear.

In another embodiment an accessory attachment apparatus for attaching to a headgear apparatus comprises a band member for detachably fitting about the circumference of the headgear. The apparatus further includes a lower stop which cooperates with the band member to engage the lower surface of the headgear thereby preventing the apparatus from rising upwards on the headgear. The headgear accessory apparatus additionally includes an accessory permanently mounted to the band member. The accessory is selected from the group consisting of a headlamp, goggle, headphone, ear muffs, ear plug, night vision goggle, helmet camera, rear light, visor, brim, and mirror.

In another embodiment, the band member has an adjustable size feature for snugly securing the band to the circumference of various sized headgear. In another embodiment, the adjustable size feature comprises a rope and clip.

In another embodiment, the apparatus further comprises an upper band size adjustment member to adjust the diameter of the band member to securely fit the headgear.

In another embodiment, an accessory attachment apparatus for attaching to a sports helmet comprises a band member sized for fitting about the circumference of the sports helmet. The accessory attachment apparatus also includes an accessory connector disposed on the band member for mounting a headgear accessory such as, for example, a headlamp, camera, mirror, mosquito netting, or brim to the band member. The accessory attachment apparatus also includes a stop disposed on a lower region of the band member. The stop is engagable with the lower surface of the helmet thereby preventing the apparatus from rising upwards on the helmet. In one embodiment, the band member comprises a fixed size.

In another embodiment, the apparatus comprises a band size adjustment feature for adjusting the size of the band member to snugly fit and secure to the circumference of various sized headgear.

In another embodiment, an accessory attachment apparatus for attaching to a sports helmet comprises a band member sized for fitting about the circumference of the sports helmet. The band member also includes spatial control members that create a shape in the flexible band for receiving the shape of the headgear. A size adjustment feature such as a strap and buckle cooperates with the flexible band to snugly engage the headgear after tensioning.

In another embodiment, the apparatus has a flexible band that is pre-contoured to receive the shape of the headgear. The pre-contoured flexible band achieves a custom fit to the headgear by tightening a size adjustment feature.

In another embodiment, the apparatus has a flexible band with a smaller lower section circumference compared to the upper section on the flexible band.

In another embodiment, the apparatus comprises a flexible band member and a visor bill accessory. The visor bill accessory is attached to the flexible band member so as to form a gap between the visor bill and flexible band, allowing air to pass there through when traveling at speed or encountering wind.

In another embodiment, the apparatus is attached to a brim accessory with a lateral adjustment feature.

In another embodiment, the apparatus is attached to a brim accessory with a removable stiffener.

In another embodiment, an apparatus for securely holding headgear accessories onto headgear, such as helmets and hard hats, in the environment in which the headgear and accessory is designed to be used, namely outdoors, windy conditions, or high speeds, is provided without the use of glue, velcro, or screw-type fasteners to secure the headgear accessory to the helmet.

DETAILED DESCRIPTION

Before the present invention is described in detail, it is to be understood that this invention is not limited to particular variations set forth herein as various changes or modifications may be made to the invention described and equivalents may be substituted without departing from the spirit and scope of the invention. As will be apparent to those of skill in the art upon reading this disclosure, each of the individual embodiments described and illustrated herein has discrete components and features which may be readily separated from or combined with the features of any of the other several embodiments without departing from the scope or spirit of the present invention. In addition, many modifications may be made to adapt a particular situation, material, composition of matter, process, process act(s) or step(s) to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail).

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. It is also to be appreciated that unless defined otherwise, all technical and scientific terms used herein have the same meaning as commonly understood by one of ordinary skill in the art to which this invention belongs.

Figure 1:
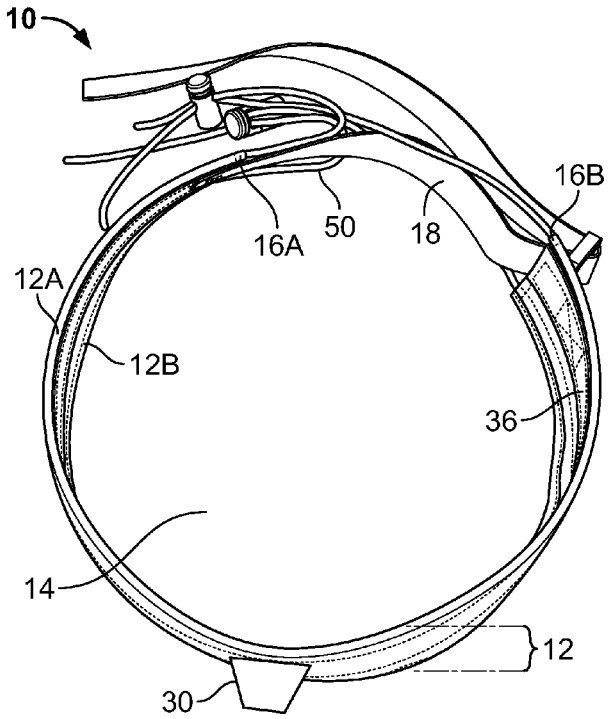
FIG. 1 is a top view of a headgear accessory attachment apparatus.
Figure 2:
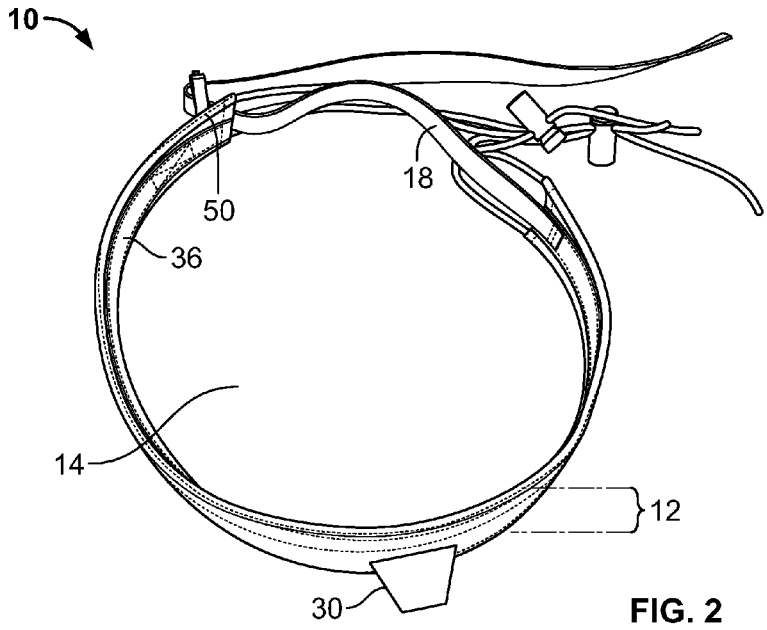
FIG. 2 is a bottom view of the headgear accessory attachment apparatus of FIG. 1.
Figure 3:
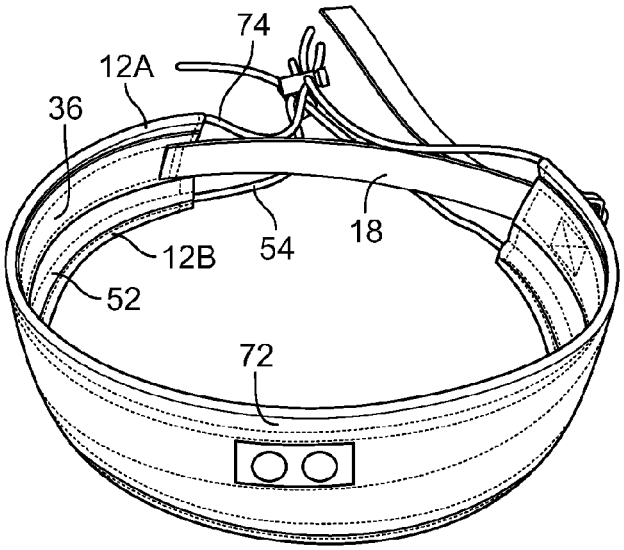
FIG. 3 is a front perspective view of the headgear accessory attachment apparatus of FIG. 1.
Figure 4:
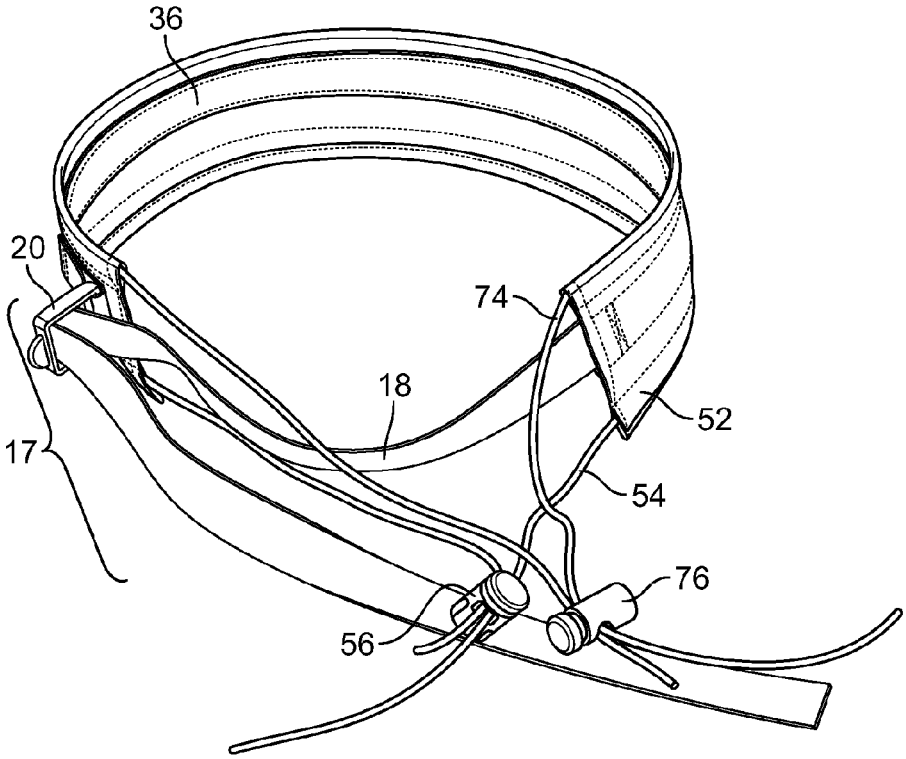
FIG. 4 is a rear perspective view of the headgear accessory attachment apparatus of FIG. 1.

FIGS. 1-6 illustrate a headgear accessory attachment apparatus 10 for use on protective headgear 40, such as outdoor sports helmets, military helmets, and hard hats. As shown in FIGS. 1 and 2, the apparatus 10 comprises a flexible band 12 defining an opening 14 through which at least a portion of the headgear can pass or fit. The band 12 may be contiguous or may have ends 16A and 16B, as shown in FIG. 1. The ends 16A, 16B may be brought closer together via a size adjustment feature 17, shown as a strap 18 and buckle 20 in FIG. 4, or other suitable device. The size adjustment feature or means adjusts the diameter of the opening 14 as shown by the strap 18 in FIGS. 5-6, to accommodate helmet 40. The band is shown secured about the circumference of the helmet 40. It is to be understood, however, that although the size adjustment member is shown as a strap 18 in FIGS. 1-6, the size adjustment feature or means may take other forms and include but is not limited to complementary hook and loop straps, interlocking buckles, snaps, elastic, and other devices.

In FIGS. 1-6, the accessory attachment apparatus 10 is shown having an accessory 30 permanently mounted to the attachment apparatus 10 and a headlamp is depicted as the accessory. However, it is to be understood that any number of accessories commonly used with headgear, such as headlamps, goggles, night vision goggles, helmet cameras, rear lights, visors, brims, decorative material, decorative embellishments, and other devices may be attached to the attachment apparatus 10. The accessory 30 may be attached anywhere on the attachment apparatus 10 provided the accessory still remains functional.

The attachment apparatus 10 may be made of a wide variety of materials. Examples of materials include without limitation cotton, nylon, polyester, fabric blends, foam, coated foams, lightweight and flexible plastic, or other suitable material.

The band 12 may also have a section of anti-slip material 36 to facilitate frictional engagement with the headgear 40. The anti-slip material 36 may be made of rubber, rubberized fabrics, coated foam, combinations thereof, or other suitable material.

In FIG. 1, the anti-slip area 36 is shown on an inner surface of the apparatus 10. The band 12 shown in FIG. 1 has a top 12A and bottom 12B. The band 12 may have a bottom size adjustment feature or member 50 that allows for adjustment of the length at the band bottom 12B. This bottom size adjustment member 50 is illustrated in FIGS. 1-6 as a channel 52 in the band bottom 12B through which a rope 54 is passed and a cordlock 56 retains the rope 54 in the desired position. The bottom size adjustment feature 50 is not limited to the channel 52, rope 54 and cordlock 56 device illustrated in the figures but may include straps and buckles, hook and loop straps, elastic, magnets, and other suitable devices.

Figure 5:
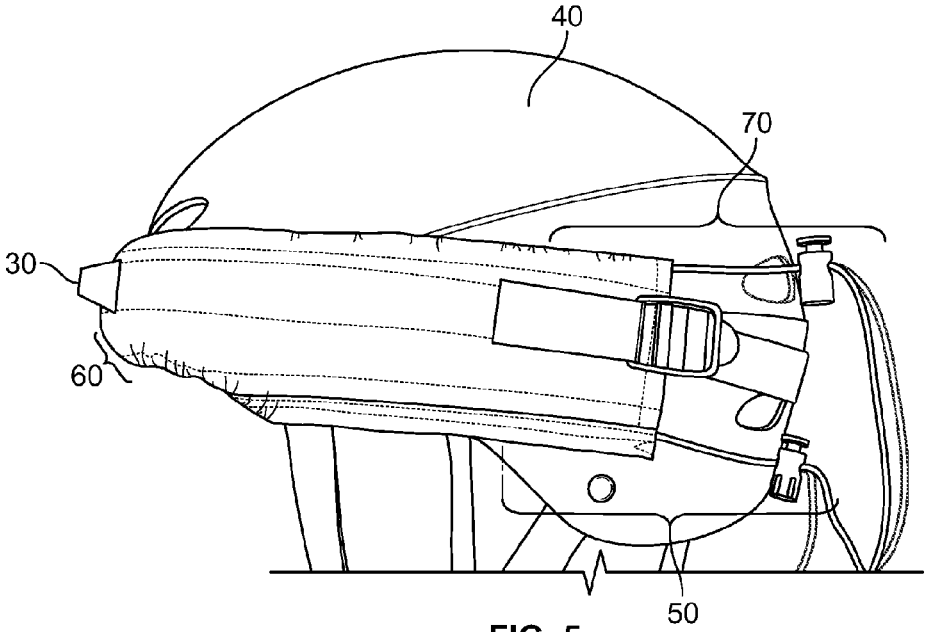
FIG. 5 is a side view of the headgear accessory attachment apparatus of FIG. 1 secured to a helmet.
Figure 6:
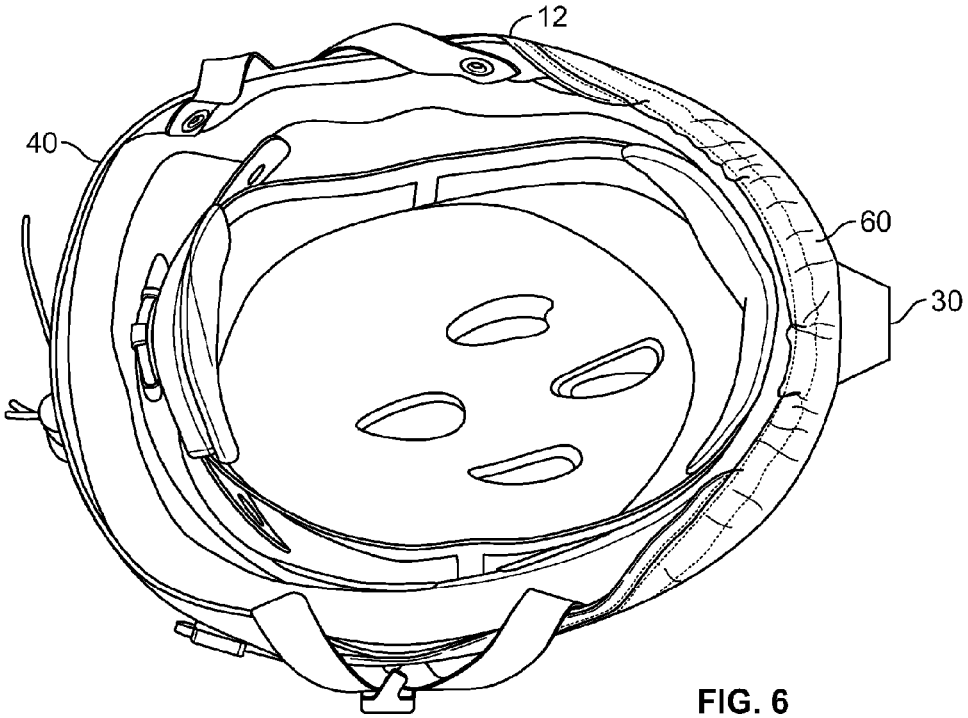
FIG. 6 is a bottom view of the headgear accessory attachment apparatus and helmet of FIG. 5.

With reference to FIGS. 1-4, the apparatus and band are shown at rest and without headgear. In the first or rested state, the band is flexible, loose, or floppy. In the first state, the band is not firm. In contrast, and with reference to FIGS. 5-6, the band is shown in an active state or second configuration. The second state or configuration is different than the first state. The band shown in FIGS. 5-6 is tight, or taut, about a lower portion of the headgear 40. In particular, in the embodiment shown in FIG. 6, the bottom size adjustment member 50 creates a firm clamping or stop surface 60 when properly attached to the headgear 40. The stop 60 opposes a portion of the underside of the headgear 40 (e.g., a lower edge of the helmet) and prevents the attachment apparatus 10 from coming off the headgear 40 in an upward direction during use and allows for secure attachment of the apparatus 10 to the headgear 40.

In FIG. 5, the stop surface 60 is shown having an arcuate profile. However the shape of the stop surface may vary. In embodiments the stop surface may have less curvature. For example, the stop surface may comprise planar surfaces which intersect at an angle. The angle may range from 1 to 180 degrees, more preferably from 5 to 140 degrees, and in some embodiment from 90 to 135 degrees.

Additionally, in FIG. 5, the band profile as a whole is shown having a U-shape. However, the band 12 may have other profiles including, for example, a V-shape.

The clamping or stop surface 60 arises from the design of the attachment apparatus 10 and may be accomplished in a number of ways. For example, as an alternative to the bottom size adjustment member 50 shown in FIGS. 1-6, the band 12 may have a spatial control member that serves to control the spacing of the band bottom 12B relative to the rest of the band and that forms a stop surface 60 when properly attached to the headgear. Examples of spatial control members include but are not limited to stitches, clips, staples, ties, etc. The spatial control feature may not be externally visible and can be hidden during manufacture of the apparatus. Additional examples of stop surfaces which may be combined with the accessory apparatus described herein for engaging the headgear are shown and described in Provisional Patent Application No. 61/445,031, filed Feb. 21, 2011, and entitled "BRIM FOR ATTACHING TO HEADWEAR"; Provisional Patent Application No. 61/480,004, filed Apr. 28, 2011, and entitled "BRIM FOR ATTACHING TO HEADWEAR"; Non-provisional Utility patent application Ser. No. 13/400,309, filed Feb. 20, 2012, and entitled "BRIM FOR ATTACHING TO HEADGEAR"; and design patent application Ser. No. 29/403,699, entitled "SPORTS HELMET BRIM", and Ser. No. 29/403,703, entitled "BIKE HELMET BRIM", both of which were filed Oct. 10, 2011; and Ser. No. 29/430,311, entitled "HEADGEAR VISOR", and filed Aug. 23, 2012.

FIGS. 1-6 show band 12 having an upper size adjustment member 70. It is used to control the length of the band top 12A relative to the length of the remainder of the band. The upper size adjustment member 70 is illustrated in FIGS. 1-5 as a channel 72 in the band top 12A through which an upper rope 74 is passed and a cordlock 76 retains the upper rope 74 in the desired position. The upper size adjustment feature 70 is not limited to the channel 72, rope 74 and cordlock 76 device illustrated in the figure but may include, for example, straps and buckles, hook and loop straps, elastic, and other suitable devices. The upper size adjustment feature 70 is used to securely hold the band 12 against the headgear and to prevent the weight of an accessory 30 from flopping down the band.

In a method of using the apparatus with a helmet, the apparatus 10 is pulled over the headgear 40, with the headgear 40 going through the opening 14 of the band 12 and engaging the anti-slip material 36, as shown in FIGS. 5 and 6. When the apparatus 10 is affixed to the headgear, the band 12 is adapted to form a clamping or stop surface 60, wherein the stop surface provides secure attachment to the headgear and prevents upward rotation.

FIGS. 7-12 illustrate another headgear accessory attachment apparatus 110 for use on protective headgear 140, such as outdoor sports helmets, military helmets, and hard hats. The apparatus 110 comprises a flexible band 112 defining an opening 114 through which at least a portion of the headgear can fit or pass. The band 112 may be contiguous or may have ends 116A and 116B, as shown in FIG. 7*a*. The opening 114 is defined by band 112, if contiguous, or by bringing the ends 116A, 116B closer together via a strap 118 and buckle 120, as shown in FIG. 10C, or other suitable device. The size adjustment assembly or means 117 adjusts the diameter of the opening 114 to accommodate headgear of varying size. The size adjustment member may vary, and may include but is not limited to complementary hook and loop straps, interlocking buckles, snaps, elastic, magnets, and other devices.

Figure 7A:
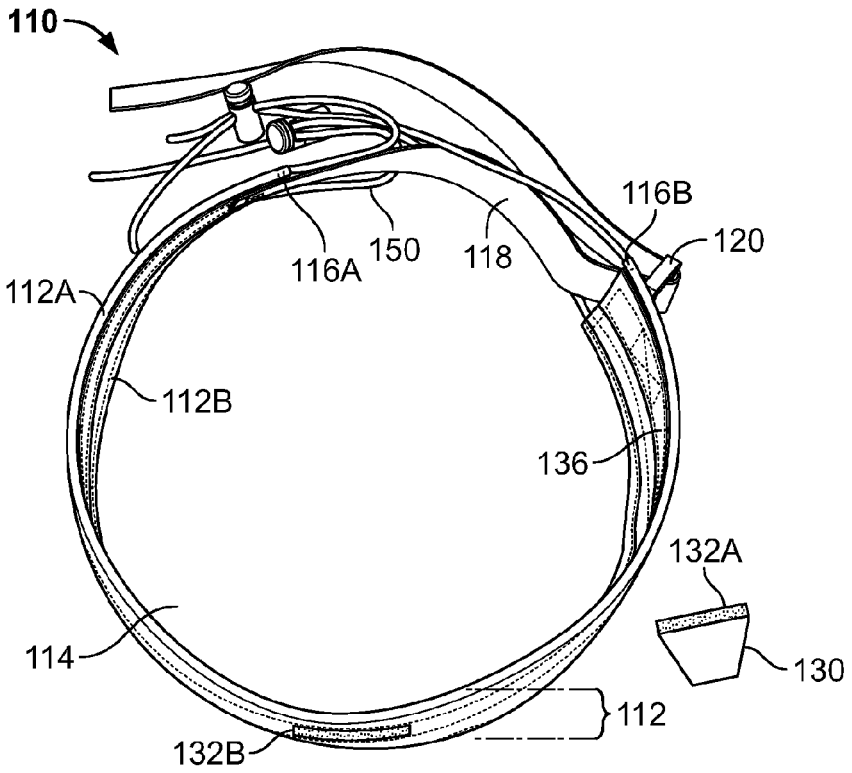
FIG. 7*a* is a top view of another headgear accessory attachment apparatus.
Figure 11:
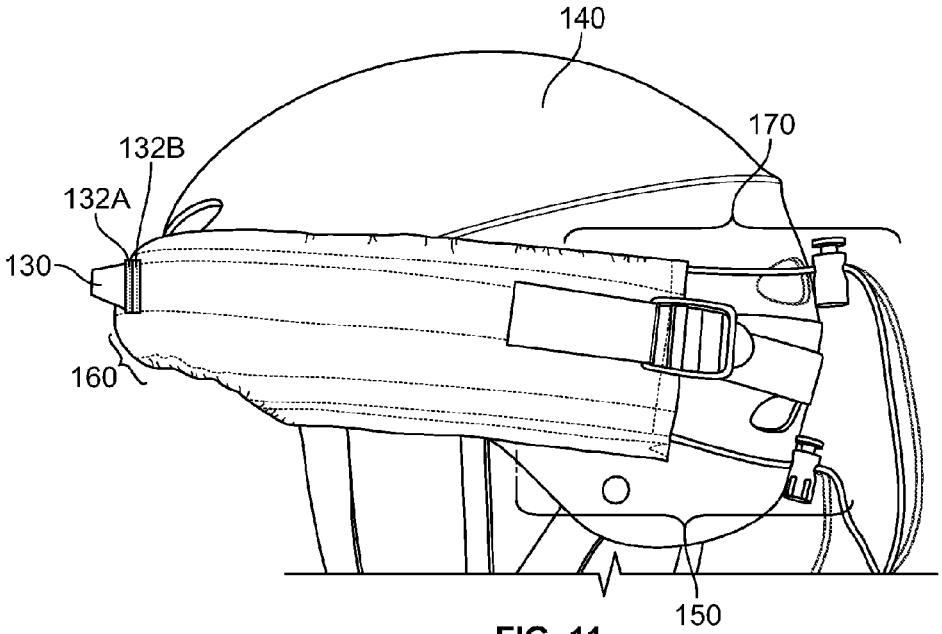
FIG. 11 is a side view of the headgear accessory attachment apparatus of FIG. 7 secured to a helmet.

With reference to FIG. 7*a*, the accessory attachment apparatus 110 is shown with a detached accessory 130. The accessory 130 and apparatus 110 have complementary engaging devices or connector assembly 132A and 132B. The complementary engaging devices or accessory connectors may consist of but are not limited to hook and loop fasteners, male and female sides of snaps, mating clips, magnets, complementary click together devices, VELCRO®, a strap fastened to the band member and a hook, clip, or other suitable device that can hang on the fastened strap, and other suitable materials. The complementary engaging devices 132A and 132B may be positioned on any location of the accessory 130 and apparatus 110, respectively, except locations that prohibit functionality. For example, Velcro strip 132B may be adhered or stitched to the band and the complimentary Velcro 132A may be bonded or otherwise joined to the headlamp 130 or other accessory. FIG. 11 shows the accessory 130 secured to apparatus 110 via the connector assembly.

Figure 7B:
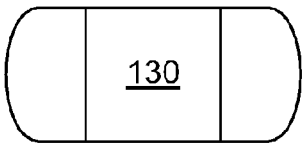
FIGS. 7*b*-7*c* are front and side views respectively of a headlamp with a loop member.
Figure 7C:
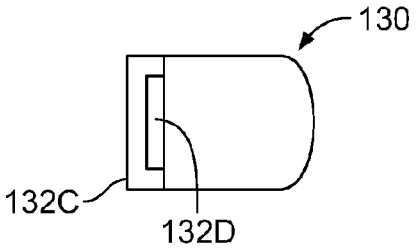
Figure 8A:
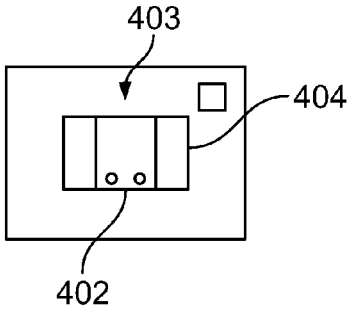
FIGS. 8*a*-8*f* show various views of a camera accessory and connector assembly.
Figure 8B:
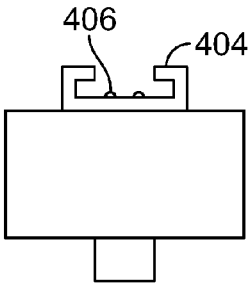
Figure 8C:
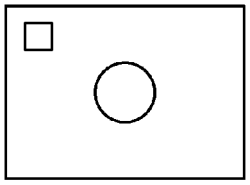
Figure 8D:
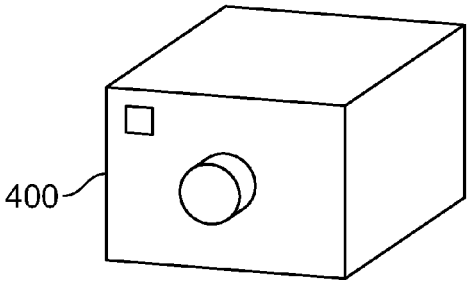
Figure 8E:
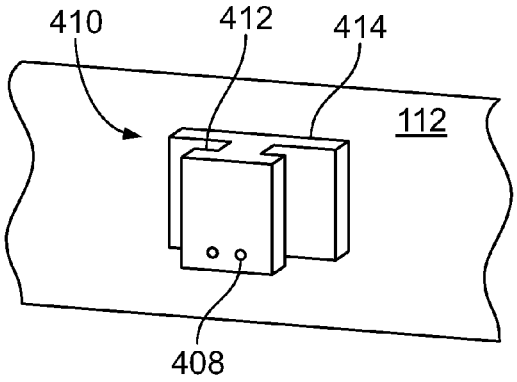
Figure 8F:
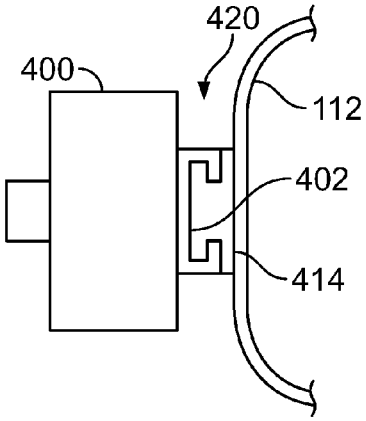

FIGS. 7*b*-7*c* show an alternative to the complementary engaging components shown in FIG. 7*a*. The accessory 130 shown in FIG. 7*c* includes a band engaging member such as a loop 132C. Non limiting examples of band engaging members include: a loop, hook, C-shaped partially closed loop, clip, or other suitable device. The band engaging member has a receiving space 132D for receiving a portion of the band member. A portion of the flexible band member extends through the engaging member receiving space. The band 112 slides through the loop or clip and is held in place with the tension generated between the inner surface of the band 112 and the headgear 140 after the apparatus 110 has been tightened onto the headgear 140. This alternative would not require a complementary engaging device 132B on the apparatus 110 shown in FIG. 7*a*. The loop 132C or clip may be contiguous or only partially encompassing the band 112. Additionally, the loop 132C could have a one side of a complementary engaging device for use with various accessories containing the mating complement.

FIGS. 8*a*-8*f* show another connector assembly or connector means 420 for mounting an accessory 400 to the helmet accessory band 112. The accessory 400 shown in FIGS. 8*a*-8*f* is a camera. An example of a camera is the HD Hero manufactured by GoPro (Half Moon Bay, Calif., USA).

The connector assembly 420 shown in FIGS. 8*a*-8*f* includes two components 403 and 410 which are adapted to complimentary engage with one another. In particular, in the embodiment shown in FIGS. 8*a*-8*f*, a base component 403 includes a plate 402 and two arm members 404 which protrude from the plate 402 and form a slot or cavity for receiving a complimentary plug component 410. The base 403 is shown attached to the camera 400, and the plug 410 is shown attached to the helmet accessory band 112.

The plug 412 is inserted into the cavity or slot of the base 403. The components may be designed so that they are snap or friction fit together. Also, as shown, one or more protrusions 406 extend from the base 402 and snap fit into a locking engagement with dimples 408 in the plug 410. However, as discussed herein, the connector components may vary widely and are not to be limited to a particular structure or shape except where specifically recited in the appended claims. Additionally, the connector components may be mounted differently than shown. The plug member 410 may be mounted to the accessory 400 and the base may be mounted to the band 112, or vice versa.

The type of accessories may vary widely. FIGS. 9*a*-9*f* illustrate a band 112 and various accessories commonly used with headgear and which may be attached to the headgear such as a helmet (not shown). The accessories shown in FIGS. 9*b*-9*f* are equipped with a plug type connector which engages a base connector 412 on the band 112. However, as described above, the connector assemblies may vary and other types of connectors may be used to secure the accessory to the band 112.

Figure 9A:
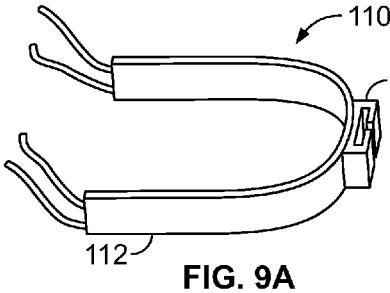
FIG. 9*a* is a perspective view of a headgear accessory attachment apparatus and a connector portion.
Figure 9B:
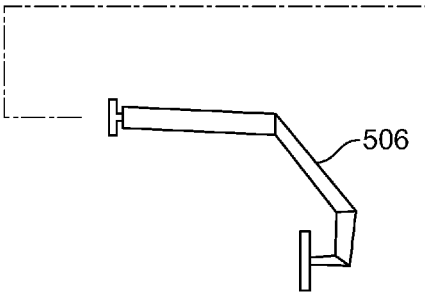
FIGS. 9*b*-9*f* are illustrations of various types of accessories and connector components to attach to the headgear accessory attachment apparatus shown in FIG. 9*a;*

FIG. 9*b* shows a rear view mirror which may be connected to band 112. An example of this accessory is the Blackburn Bike Helmet Mirror, manufactured by Easton Bell Sports Inc. (Van Nuys, Calif.).

Figure 9C:
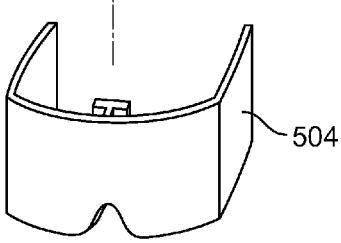

FIG. 9*c* shows night vision goggles which may be connected to band 112. An example of this accessory is LNPBG-1 1x Premium Night Vision Goggles, manufactured by Luna Optics (Staten Island, N.Y.).

Figure 9D:
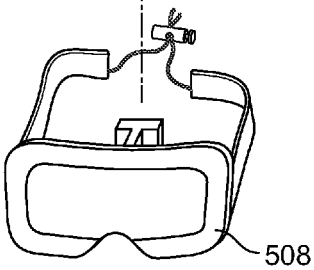

FIG. 9*d* shows ski goggles which may be connected to band 112. An example of this accessory is Recoil XI Goggle, manufactured by Scott Sports (Givisiez, Switzerland).

Figure 9E:
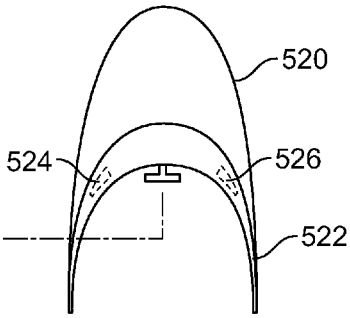

FIG. 9*e* shows a visor or brim 520 which may be connected to band 112. Additionally, the brim 520 includes multiple connectors. A plug connector 522 is shown in the front center portion of the brim. Additional connector features 524 and 526 are shown to the left and right of the plug connector 522. The additional connector features may be provided to further secure the brim to the band 112. Indeed, multiple connector features, at multiple locations, may be provided to secure the accessory to the band.

Figure 9F:
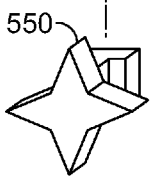
Figure 10A:
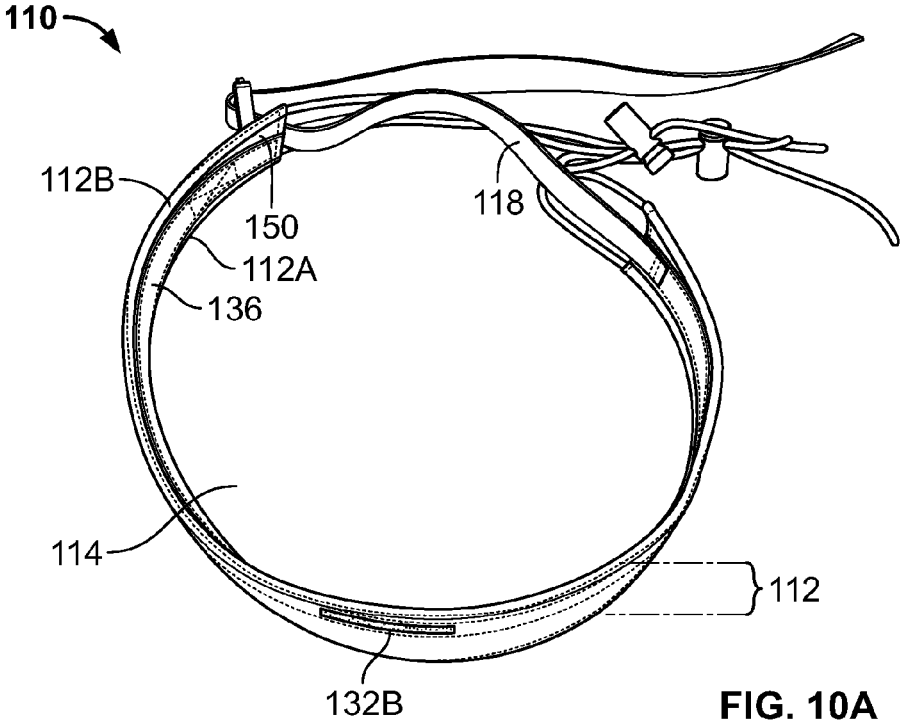
FIG. 10*a* is a bottom view of the headgear accessory attachment apparatus of FIG. 7.
Figure 10B:
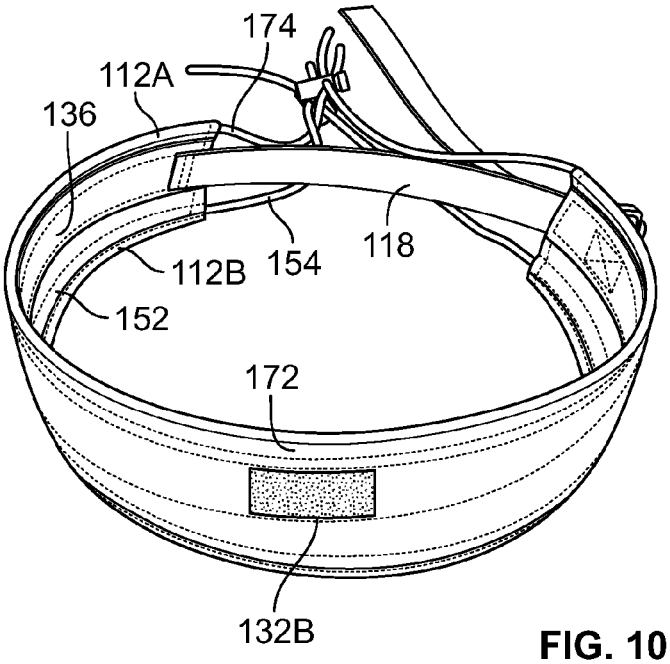
FIG. 10*b* is a front perspective view of the headgear accessory attachment apparatus of FIG. 7.
Figure 10C:
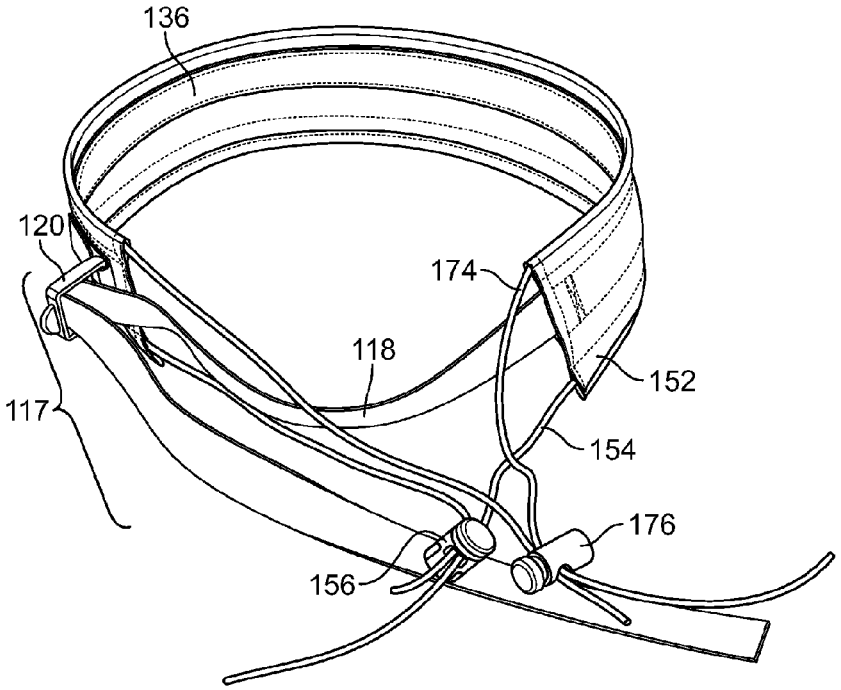
FIG. 10*c* is a rear perspective view of the headgear accessory attachment apparatus of FIG. 7.

FIG. 9*f* shows a design embellishment 550, namely a star shaped pin, which may be connected to band 112. Though a star shape is shown, any type of design, logo, ribbon, or indicia, may be joined to the band.

Still other accessories than that described above may be secured to the headgear using band 112. Non limiting examples include headlamps, goggles, night vision goggles, helmet cameras, rear lights, visors, brims, decorative material, headphones, ear muffs, ear plugs, decorative embellishments, mosquito netting, and other devices may be attached to the attachment apparatus 110 with a connector.

The attachment apparatus 110 shown in FIGS. 7-12 may be made of similar materials to those described above in connection with the embodiment shown in FIGS. 1-6. The band 112 may also have a section of anti-slip material 136 to facilitate frictional engagement with the headgear 140. The anti-slip material 136 may be made of rubber, rubberized fabrics, coated foam, combinations thereof, or other suitable material.

The band 112 depicted in FIGS. 7-12 has a top 112A and bottom 112B. The band 112 may have a bottom size adjustment feature 150 that allows for adjustment of the length at the band bottom 112B. The bottom size adjustment feature 150 illustrated in FIGS. 7-12 comprises a channel 152 in the band bottom 112B through which a rope 154 is passed and a cordlock 156 retains the rope 154 in the desired position. The bottom size adjustment member 150, however, is not limited to a channel 152, rope 154 and cordlock 156 device illustrated in the figure but may include a wide variety of other types of adjustment members including, for example, straps and buckles, hook and loop straps, elastic, and other suitable devices.

The bottom size adjustment feature 150 is used to create a stop surface 160 when properly attached to the headgear 140. The stop or clamping surface 160 opposes a portion of the underside of the headgear 140 (e.g., an edge) and prevents the attachment apparatus 110 from coming off the headgear 140 in an upward direction during use and allows for secure attachment of the apparatus 110 to the headgear 140.

The stop surface 160 arises from the design of the attachment apparatus 110 and may be accomplished in a number of ways. For example, as an alternative to the bottom size adjustment feature 150 described above, the band 112 may have a spatial control member that serves to control the spacing of the band bottom 112B relative to the rest of the band and that forms a stop surface 160 when properly attached to the headgear. Examples of spatial control members include but are not limited to stitches, clips, staples, ties, etc. The spatial control feature may not be externally visible and can be hidden during manufacture of the apparatus. The spatial control feature may vary. Additionally, the band bottom 112B can be shortened relative to the region of the band 112 above the band bottom 112B to preserve functionality of the stop surface 160 when the apparatus 110 is placed on headgear.

The band 112 may have an upper size adjustment feature or member 170 that is used to control the length of the band top 112A relative to the length of the remainder of the band. The upper size adjustment feature 170 is illustrated in FIGS. 7-12 as a channel 172 in the band top 12A through which an upper rope 174 is passed and a cordlock 176 retains the upper rope 174 in the desired position. However, the upper size adjustment feature 170 is not limited to the channel 172, rope 174, and cordlock 176 device illustrated in the figure but may include straps and buckles, hook and loop straps, elastic, and other suitable devices. The upper size adjustment feature 170 is used to securely hold the band 112 against the headgear and to prevent the weight of an accessory 130 from flopping down the band.

Figure 12:
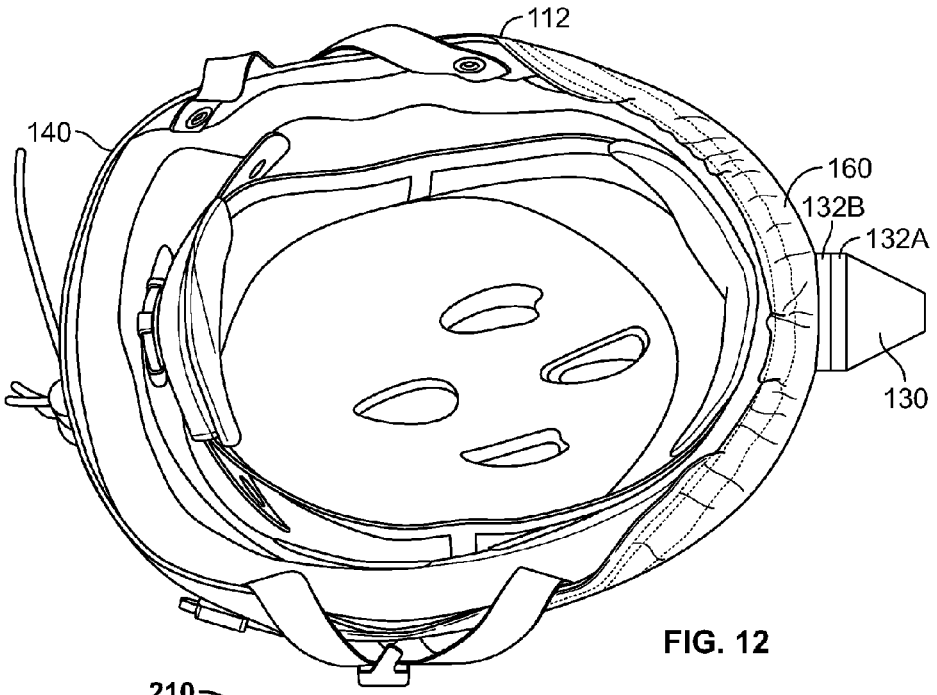
FIG. 12 is a bottom view of the headgear accessory attachment apparatus and helmet of FIG. 11.

In a method of using an accessory apparatus with a helmet, the apparatus 110 is pulled over the headgear 140, with the headgear 140 going through the opening 114 of the band 112 and engaging the anti-slip material 136 by tightening the size adjustment member or assembly 117, as shown in FIGS. 11 and 12. When the apparatus 110 is affixed to the headgear, the band 112 is adapted to form a stop surface 160, wherein the stop surface provides secure attachment to the headgear and prevents upward rotation. After installation, the band deforms and wraps around the helmet to provide a conforming and secure fit. An accessory 130 can be changed out at will via a complementary engaging device 132A, 132B or by sliding a loop 132C over the band 112.

Figure 13:
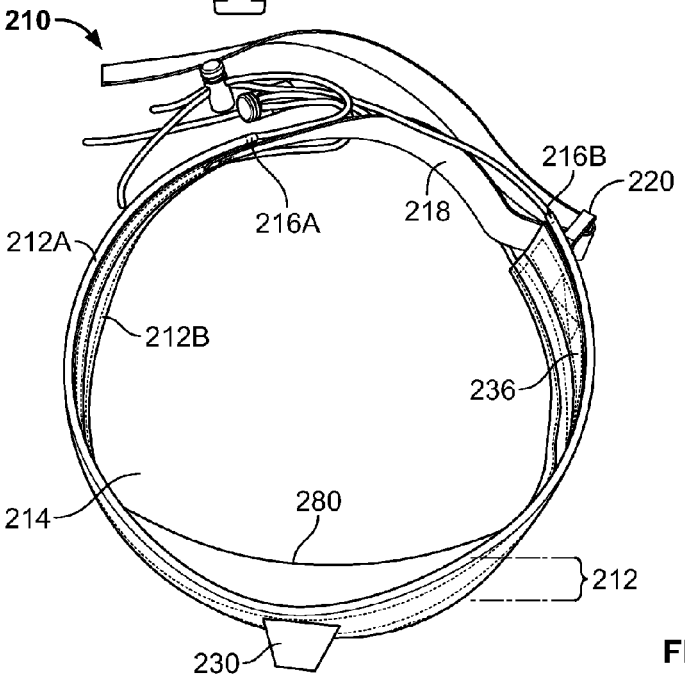
FIG. 13 is a top view of another headgear accessory attachment apparatus including a front support.

FIG. 13 illustrates another headgear accessory attachment apparatus 210 similar to the apparatus described herein except that it includes a reinforcing member or flap 280. The flap 280 can be attached to the band bottom 212B. The front flap 280 helps prevent the apparatus 210 from coming off the headgear when traveling at high speeds. If a brim or visor is being used as an accessory, the front flap 280 may also be effectively created by attaching—either permanently or removably—the band 212 to the top of the brim or visor a distance distal to the inner edge of the brim or visor.

The apparatus 210 shown in FIG. 13 also comprises a flexible band 212 defining an opening 214 through which headgear can fit or pass. The band 212 may be contiguous or may have ends 216A and 216B, as shown in FIG. 13. The opening 214 is shown bordered by contiguous band 212 or by bringing the ends 216A, 216B closer via a size adjustment feature, shown as a strap 218 and buckle 220 in FIG. 13, or other suitable device. A means to adjust the diameter of the opening 214, as shown by the strap 218 and buckle 220 in FIG. 13, to accommodate headgear of varying size may vary, and may include but is not limited to complementary hook and loop straps, interlocking buckles, snaps, elastic, and other devices. The band is tightened about the circumference of the helmet to snugly fit.

The accessory attachment apparatus 210 is shown having an accessory 230 permanently mounted to the attachment apparatus 210. In FIG. 13, a headlamp is depicted as the accessory. However, as stated above, any number of accessories may be attached or secured to the helmet via the accessory attachment apparatus. The accessory 230 may be attached anywhere on the attachment apparatus 210 provided the accessory still remains functional. The attachment apparatus 210 may be made as described herein.

In a method, an apparatus 210 is joined with an accessory. The apparatus is put over the headgear, with the headgear going through the opening 214 of the band 212. The band is adjusted to snugly fit and secure the band about the headgear. In some embodiments an anti-slip material 236 is present on the interior of the band, and the headgear engages the anti-slip material 236. The flap engages the helmet edge.

Figure 14:
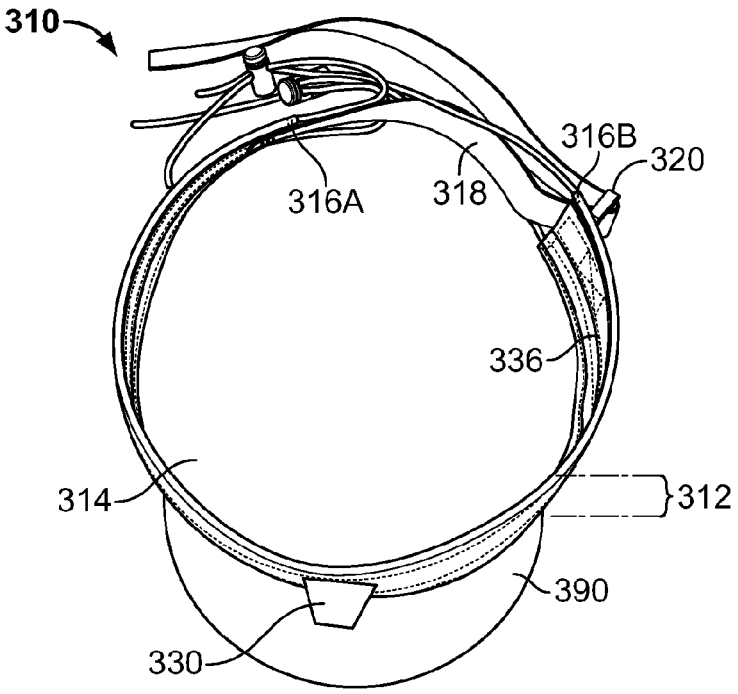
FIG. 14 is a top view of another headgear accessory attachment apparatus including a visor-receiving front pocket.

FIG. 14 illustrates another headgear accessory attachment apparatus 310 similar to the apparatuses described herein except that it includes a pocket 390. This apparatus is depicted with a permanently mounted accessory 330 but could also be used with a detachable accessory.

The pocket serves to accommodate various headgear that have a visor that is pre-integrated or molded into the headgear itself. The pocket 390 is sized to receive the pre-existing visor that was previously integrated with the helmet. The pocket further holds the apparatus on the headgear. The pocket may be made of similar materials to the band, described herein. The pocket may have hook and loop fasteners (e.g., Velcro straps) attached at opposite inner surfaces of the pocket.

In a method, the headgear pre-integrated visor is inserted into the apparatus pocket 390 and the band 312 is pulled over the headgear, with the headgear fitted through the opening 314 of the band 312 and engaging the anti-slip material 336 by tightening the strap 318 through the buckle 320 and bringing the ends of the attachment band 316A, 316B closer together. Hook and loop fasteners on the interior surfaces of the pocket are engaged around the pre-integrated visor to produce a custom, conforming, and snug fit.

FIGS. 15-21 illustrate another embodiment of a headgear accessory attachment apparatus 1410 for use on protective headgear 1440, such as outdoor sports helmets, military helmets, and hard hats. The apparatus 1410 may be made of a wide variety of materials. Examples of materials include without limitation cotton, nylon, polyester, fabric bands, foam, coated foams, lightweight and flexible plastic, or other suitable materials.

Figure 15:
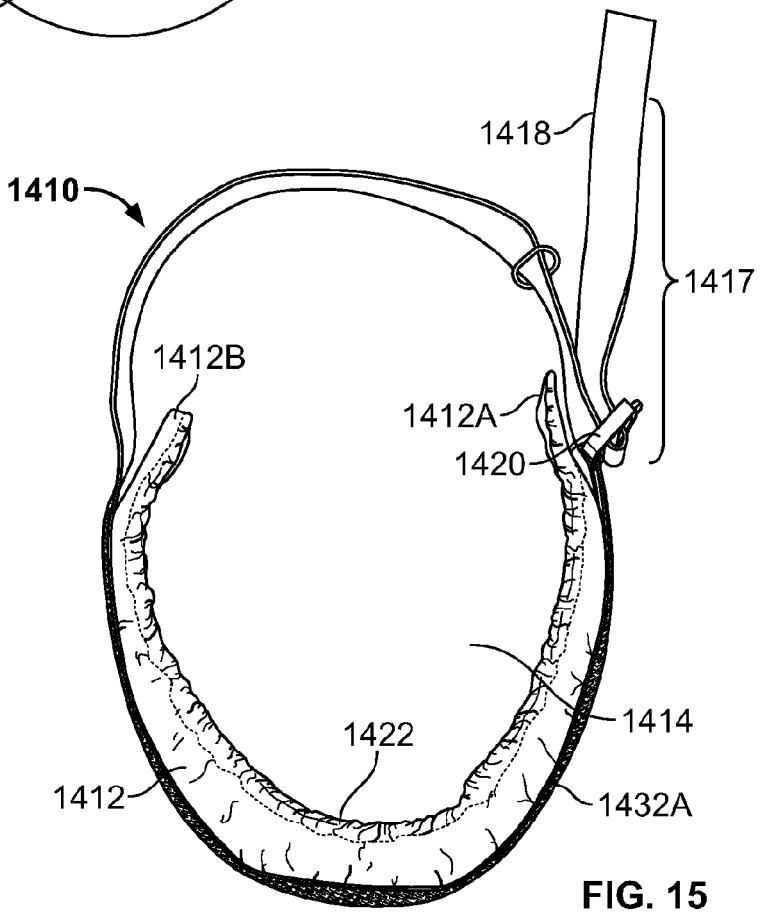
FIG. 15 is a top view of another headgear accessory attachment apparatus.
Figure 16A:
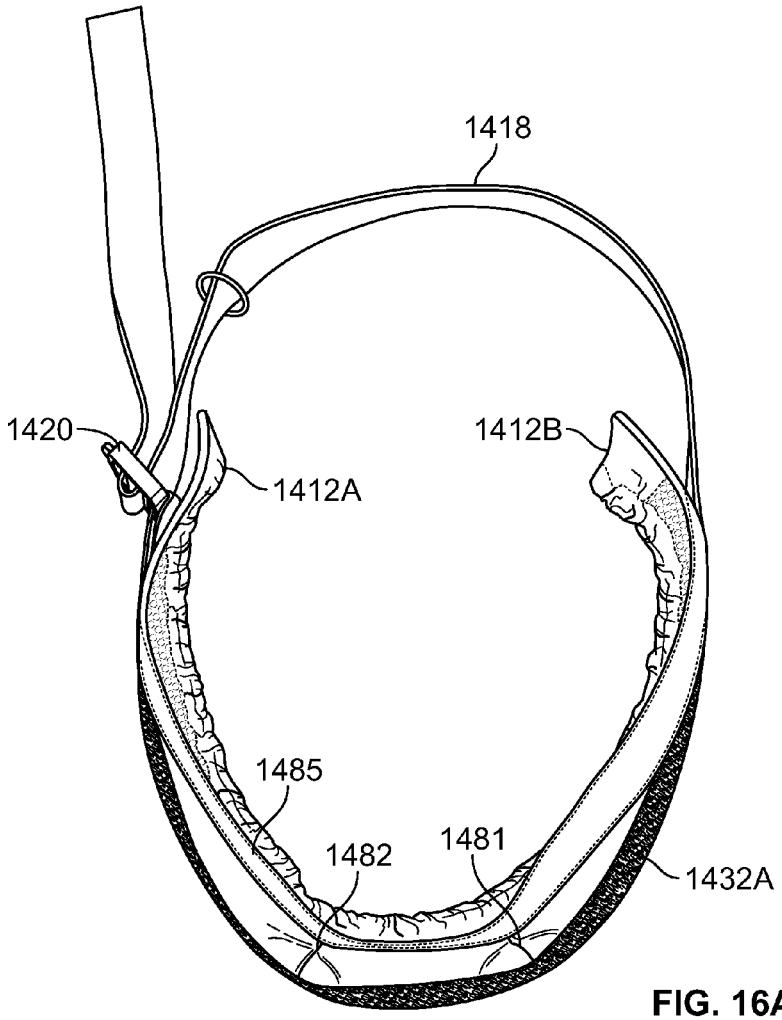
FIG. 16*a* is a bottom view of the headgear accessory attachment apparatus shown in FIG. 15.
Figure 16B:
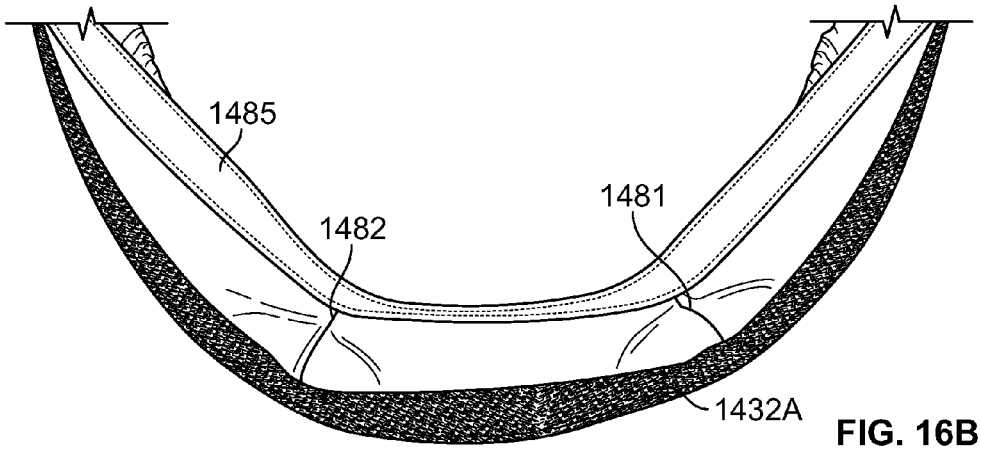
FIG. 16*b* is a partial perspective view of the headgear accessory attachment apparatus shown in FIG. 15.

The apparatus shown in FIG. 15 includes a flexible band 1412 defining an opening 1414 through which at least a portion of the headgear can pass or fit. The band 1412 may be contiguous or may have sides or ends 1412A and 1412B, as shown in FIGS. 15 and 16*a*. The sides or ends 1412A, 1412B, may be brought closer together via a size adjustment feature 1417, shown as a strap 1418 and ladder lock buckle 1420 in FIG. 15, or other suitable device. Non limiting examples of a size adjustment feature include ratcheting buckle, lock buckle, cam buckle, belt buckle, and peg and mating hole strap.

The size adjustment feature or means 1417 adjusts the diameter of the opening 1414 is shown by the strap 1418 and buckle 1420 in FIGS. 15, 16*a*, 17*a*, 20*a*, 21, to accommodate the different sizes of protective headgear 1440.

Figure 21:
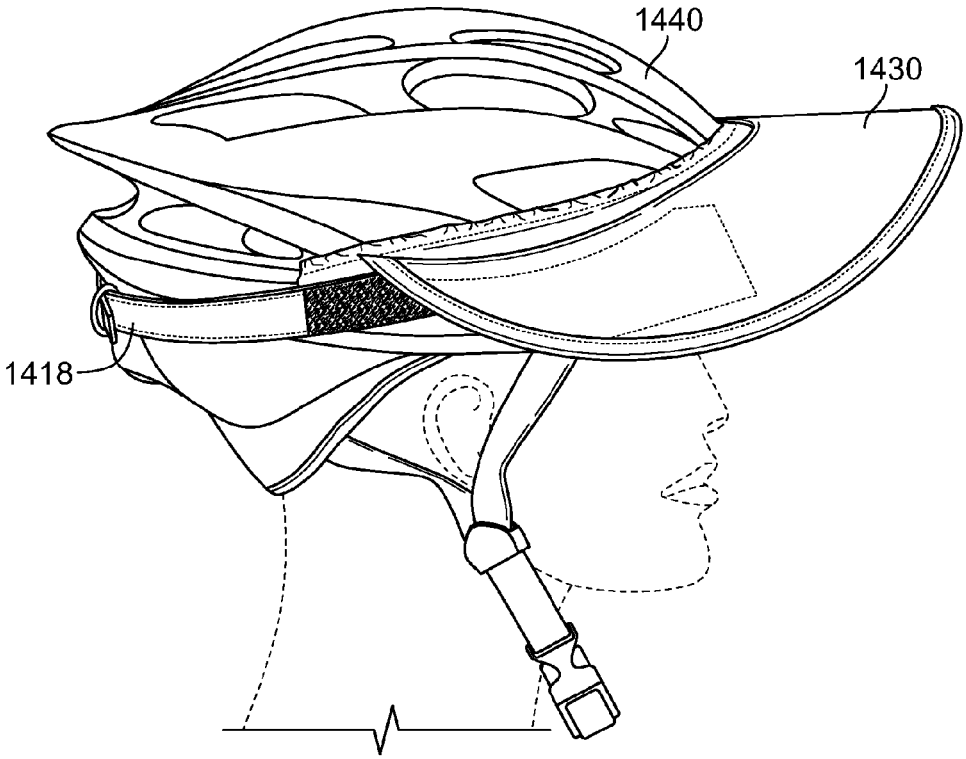
FIG. 21 is a side view of the headgear accessory apparatus of FIG. 15 and the accessory of FIGS. 19*a* and 19*b* attached to headgear.

With reference to FIG. 21, the flexible band 1412 is shown secured about the circumference of the headgear 1440. It is to be understood, however, that although the size adjustment member is shown as a strap 1418 looping through a ladderlock buckle, the size adjustment feature or means may take other forms and include but is not limited to complementary hook and loop straps, interlocking buckles, snaps, elastic, and other devices.

Figure 17A:
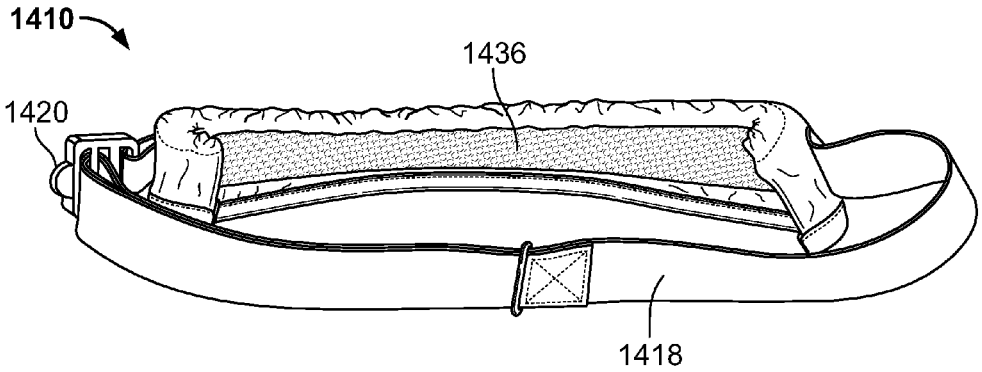
FIG. 17*a* is a rear view of the headgear accessory attachment apparatus of FIG. 15.
Figure 17B:
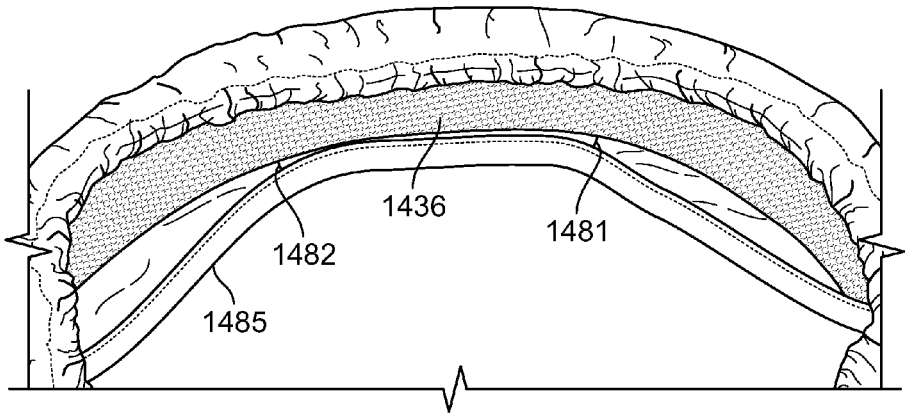
FIG. 17*b* is a partial rear view of the headgear accessory attachment apparatus of FIG. 15.
Figure 18:
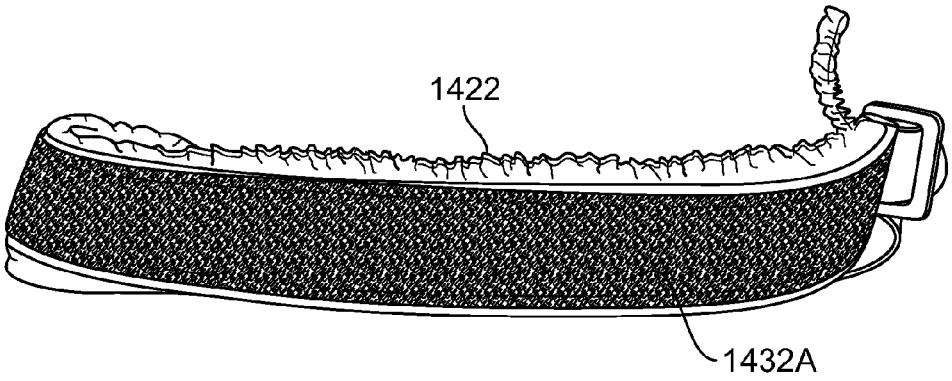
FIG. 18 is a front view of the headgear accessory attachment apparatus of FIG. 15.

With reference to FIG. 17*a*, the headgear accessory attachment apparatus 1410 may have a section of anti-slip material 1436 to facilitate frictional engagement with the headgear 1440. The anti-slip material may be configured variously. Exemplary configurations of the anti-slip material include but are not limited to multi-layered structures, composites, or fully integrated, uniform materials.

The anti-slip material 1436 may be made of rubber, rubberized fabrics, foam, coated foam, combinations thereof, or other suitable material. The anti-slip material preferably creates friction when force is applied to the opposite side of the anti-slip material. In addition, the anti-slip material may be compressible to facilitate a better grip. In FIG. 17*a*, the anti-slip area 1436 is shown on an inner surface of the apparatus 1410.

FIG. 15 shows apparatus 1410 having an elastic section 1422. The elastic section serves to bring the band in towards the surface of the headgear when the apparatus 1410 is mounted to the headgear 1440, creating a nice physical appearance.

In the embodiment shown in FIGS. 15-21, the flexible band 1412 has two spatial control members, 1481, 1482, which are illustrated as stitches. Although only two spatial control members are shown in FIG. 16*b*, more or less spatial control members may be supplied. Indeed, a wide range of spatial control members can be used. The spatial control members create a shape in the flexible band that serves to aid the engagement of the flexible band 1412 with the headgear 1440 when the apparatus 1410 is mounted to the headgear. The spatial control members may be hidden from view during manufacture. Additionally, although illustrated as stitches in FIG. 16*b*, spatial control members may consist of clips, ties, stitches, and other suitable devices. Spatial control members are shown in a bottom frontal region of the band member. The spatial control members bias or prejudice the bottom of the band to be smaller in diameter than the region above the bottom of the band. The spatial control members are shown in FIG. 16*b* towards the front and central region.

An alternative to the spatial control members is to cut the fabric of the flexible band at such an angle so as to pre-contour the flexible band to receive the contour of the headgear. The pre-contour is not rigid but flexes upon tightening of the size adjustment feature to provide a custom fit to the headgear.

The flexible band 1412 could also be sewn in such a way to restrict the circumference of a first section $ID_{first}$ of the flexible band to a smaller measurement than a second section $ID_{second}$ of the flexible band. The first section being lower than the second section. In this way, the flexible band's smaller circumference at the bottom restricts its movement up and off the helmet, providing a secure fit. In a sense, in this embodiment, the band has a tapered interior lumen.

The flexible band may also have a reinforcement ribbon 1485 to constrict the length of the flexible band 1412 at its lower edge.

Figure 20A:
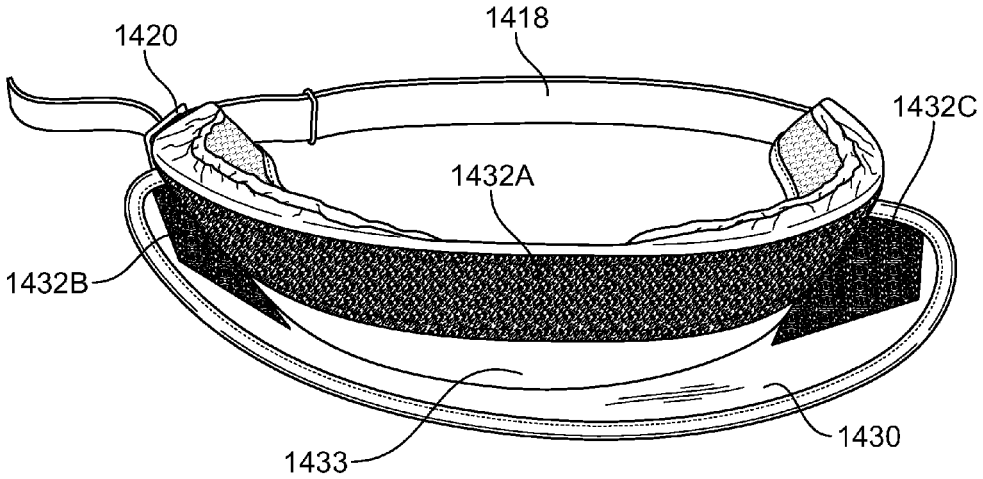
FIG. 20*a* is a front view of the headgear accessory attachment apparatus of FIG. 15 attached to the accessory of FIGS. 19*a* and 19*b* with the assembly turned upside down.
Figure 20B:
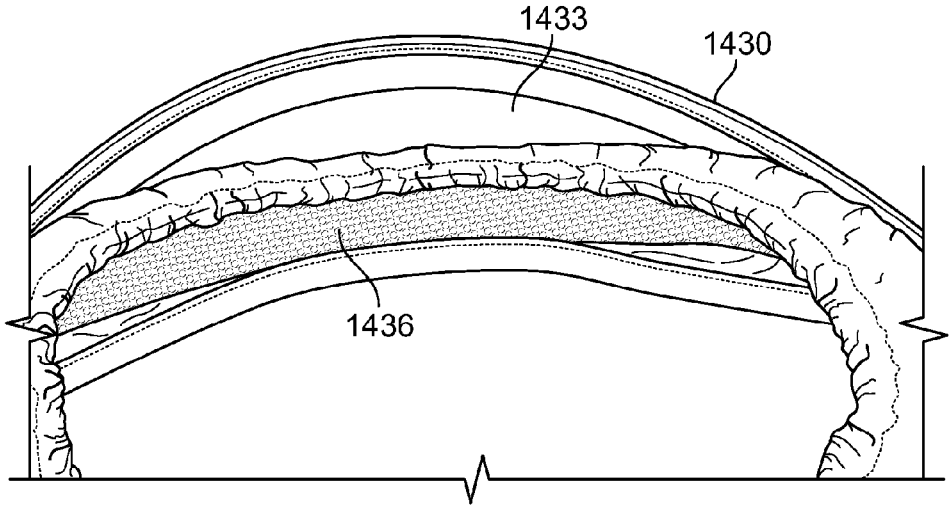
FIG. 20*b* is a partial perspective rear view of the headgear accessory attachment apparatus of FIG. 15 attached to the accessory of FIGS. 19*a* and 19*b;*

With reference to FIGS. 20*a*, 20*b*, and 21, the accessory attachment apparatus 1410 is shown with a detachable accessory 1430. In the illustrations, the detachable accessory 1430 is illustrated as a bill of a visor, although it is to be understood that a variety of detachable accessories, such as headlamps, goggles, night vision goggles, helmet cameras, rear lights, visor bills, brims, decorative material, decorative embellishments, mosquito netting, curtains, and other devices may be used. The visor bill accessory may have a stiffening member along the edge of its interior arc 1431A and the outer edge 1431B. The stiffening member provides support and helps to maintain structure of the visor bill when the visor bill is attached to the accessory attachment apparatus 1410 and the assembly attached to a helmet used under conditions with wind or higher speed of movement. The stiffeners help to prevent the brim from collapsing under the stress of the moving air. The stiffeners may be made of plastic rod, wire, nylon rod, tubing, or other suitable device. The visor bill may also be reinforced with plastic edging, piping, additional layers of foam, material, or interfacing. The stiffening members may be a single member or a plurality of members and may be located anywhere along the visor bill.

The accessory 1430 and apparatus 1410 have complementary engaging devices, such a mating hook 1432A and loop 1432B, 1432C fasteners. The complementary engaging devices may vary and may comprise snaps, mating clips, complementary click together devices, buckles, magnets, and other suitable materials. The complementary engaging devices 1432A and 1432B, 1432 C may be positioned on any location of the accessory 1430 and apparatus 1410, respectively, except locations that prohibit functionality.

In addition, there may be multiple of each type of fastener on the apparatus and the accessory, as illustrated by the loop fastener 1432B, 1432C which is present in two locations on the detachable accessory. The location, quantity, and respective fastener part type of the hook-loop, male-female pair, and so on, may vary. The accessory 1430 may be attached anywhere on the attachment apparatus 1410 provided the accessory still remains functional.

Figure 19A:
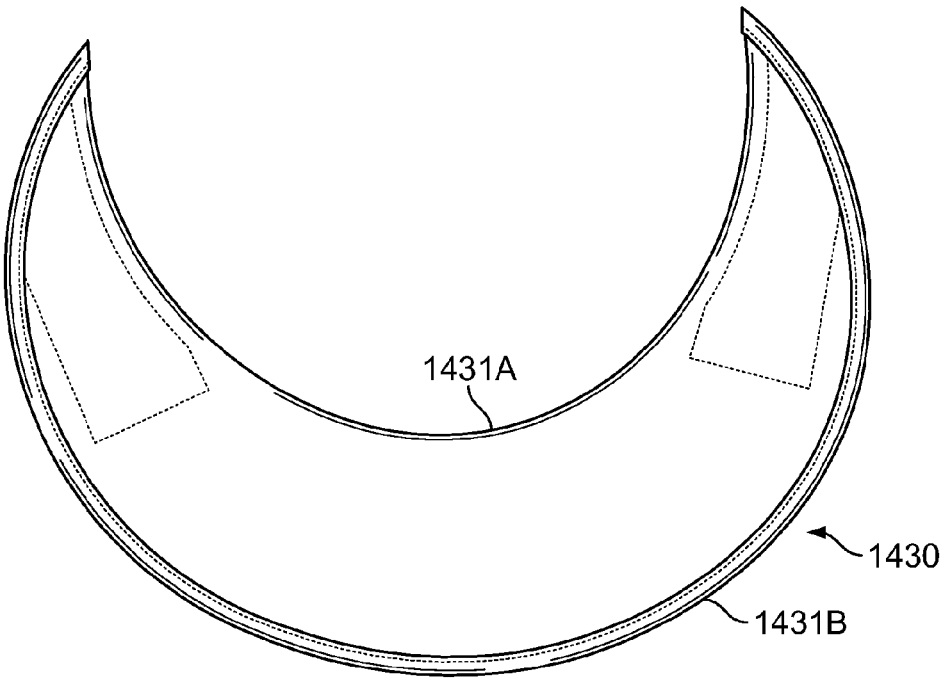
FIG. 19*a* is a top view of an accessory to be used with the headgear accessory attachment apparatus of FIG. 15.
Figure 19B:
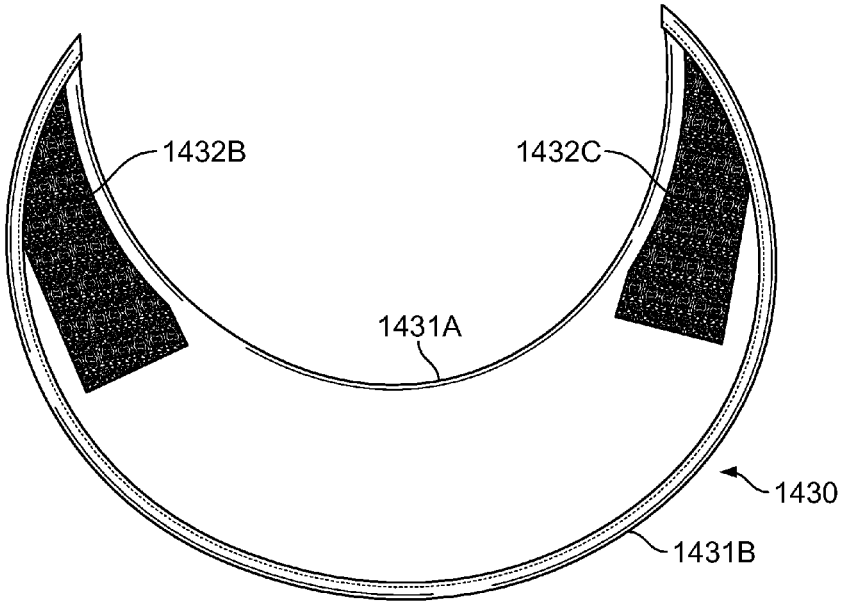
FIG. 19*b* is a bottom view of an accessory to be used with the headgear accessory attachment apparatus of FIG. 15.

FIGS. 19*a*, 19*b* show an example of an accessory, namely, a bill 1430 or visor which may be connected or detachably fastened to the band member described above.

FIGS. 20A, 20B, and 21 show the bill 1430 secured to the apparatus 1410 via the complementary engaging devices. If so desired, the visor bill accessory 1430 can be attached to the flexible band 1412 via the mating fasteners to create a gap or air channel 1433 between the flexible band 1412 and the visor bill accessory 1430 that allows air to pass. This gap 1433 can be advantageous in windy situations or when the wearer is using the apparatus while traveling at higher speeds. The gap or channel 1433 reduces the wind pressure on the apparatus that can be transferred to the headgear 1440 and the user.

With reference to FIG. 21, the apparatus is shown fixed around the circumference of headgear 1440. Strap 1418 is locked into position by the ladder lock buckle, enabling a compressible and anti-slip portion of the band member to form a multi-sided tight clamp around the circumference of the helmet and for the device to engage a front lower edge of the helmet as described above. Bill 1430 is also shown extending radially from the band member along a bill arc. The bill arc is less than 360 degrees, and more preferably ranges from 120 to 270 degrees, and most preferably from 180 to 240 degrees.

If the apparatus is to be used with headgear that does not have significant nooks at the rear in which to fit the adjustment strap, the accessory attachment apparatus may comprise additional anti-slip material sewn to the surface of the adjustment strap that will contact the headgear when the apparatus is installed. Alternatively, a tube with anti-slip material may be threaded over the adjustment strap and oriented so that the anti-slip material contacts the surface of the headgear when the apparatus is installed. The anti-slip material may be a single layer or could be multiple layers. For example the tube may comprise a layer of rubberized material attached to a layer of foam. The tube and anti-slip material will facilitate frictional engagement with the headgear after installation. The foam squishes the rubberized fabric against the surface of the helmet when the strap is pulled, providing better gripping power.

In a method of using the headgear accessory attachment apparatus 1410, the apparatus is pulled over the headgear 1440, with the headgear going through the center opening 1414 and engaging the anti-slip section 1436 by tightening the size adjustment strap 1418 through the buckle 1420. Tightening the size adjustment strap 1418 deforms the flexible band 1412 around the circumference of the headgear 1440, compresses the anti-slip material 1436 against the helmet, and warps the flexible band around the front edge of the helmet. Installation allows the apparatus 1410 to grab and securely clamp the headgear and creates a custom fit for the headgear, preventing detachment. The band compresses around a front edge of the helmet, clamping on a minimum of two surfaces of the helmet. In embodiments, when the strap is tightened, the apparatus clamps under the front side of the helmet and a surface on the front of the helmet conforming to hold the helmet at the front. In embodiments, the strap then holds the rear of the helmet by nesting into a groove in the helmet or may have a tube of anti-slip material with foam at the rear to engage the helmet frictionally at its rear. Wrapping the flexible band 1412 around the front edge of the headgear 1440 helps the apparatus 1410 to hold on to the headgear when a non-aerodynamic accessory is attached to the apparatus; without having the flexible band contact the underside of the headgear, the entire apparatus would be more likely to fly off when traveling at higher speeds.

Figure 22:
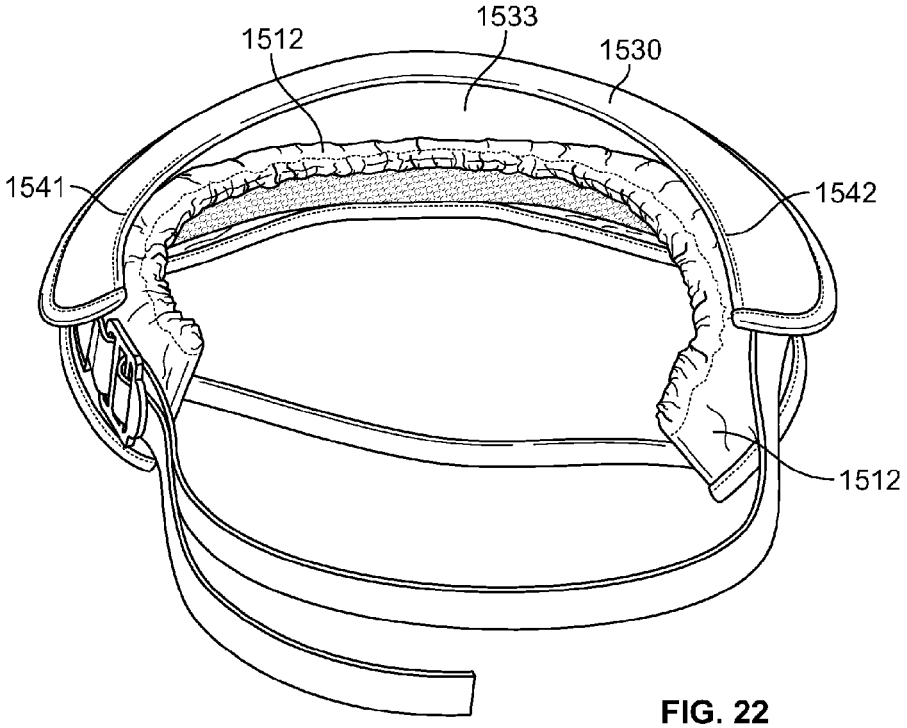
FIG. 22 is a rear perspective view of another headgear accessory attachment apparatus with an accessory.

FIG. 22 shows another embodiment of the headgear accessory attachment apparatus. In particular, the visor bill 1530 is permanently attached to the accessory attachment apparatus 1510 via stitches, 1541, 1542. The visor has been stitched in such a way to generate a gap or pressure relief aperture 1533 between the flexible band 1512 and the visor bill accessory 1530 through which air can pass. This is particularly useful if the wearer is using the apparatus in an activity that requires the wearer to move at higher speeds. This gap or pressure relief aperture will allow the air to pass through and prevents pressure from building up on the underside of the visor bill, which may shift the headgear back and out of its proper position. A method of using the apparatus is similar to that described for the apparatus pictured in FIGS. 15-21.

Figure 23:
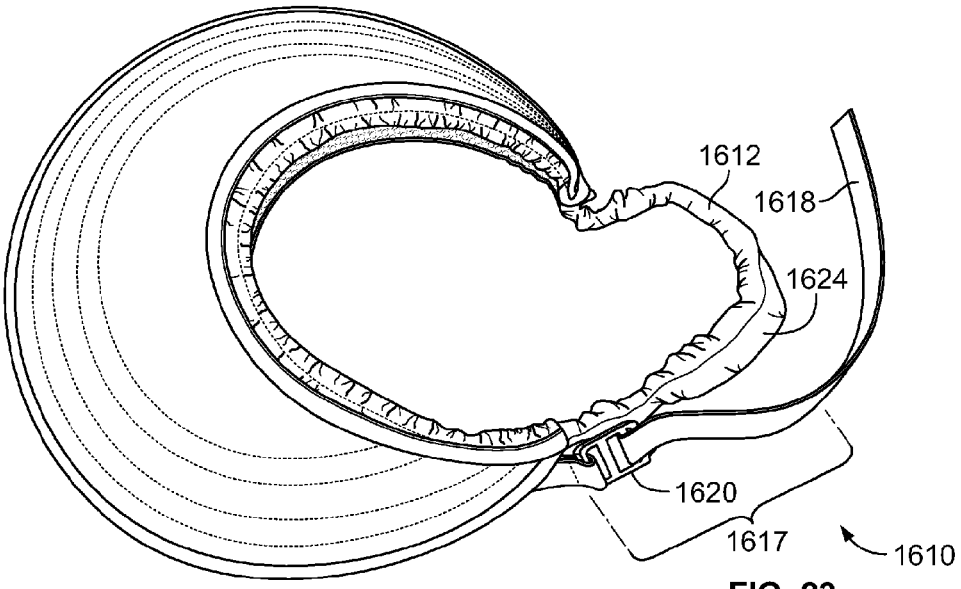
FIG. 23 is a top view of another headgear accessory attachment apparatus with an accessory.

FIG. 23 shows another embodiment of the headgear attachment apparatus 1610. In FIG. 23, flexible band 1612 is contiguous. A size adjustment feature 1617 serves to fit different size headgear. In this embodiment, the size adjustment feature consists of a strap 1618 and a ladder lock buckle 1620. However, it is to be understood that a wide variety of items may be used for the size adjustment feature including but not limited to: snaps, elastic, hook and loop fasteners, ropes, clips, buckles, and so on with sufficient holding power and tightness to retain the headgear accessory apparatus onto the helmet.

The strap 1618 runs through a channel 1624 in the flexible band before coming out of the band and through the buckle 1620. A method of using the apparatus is similar to that described for the apparatus pictured in FIGS. 15-21.

Figure 24:
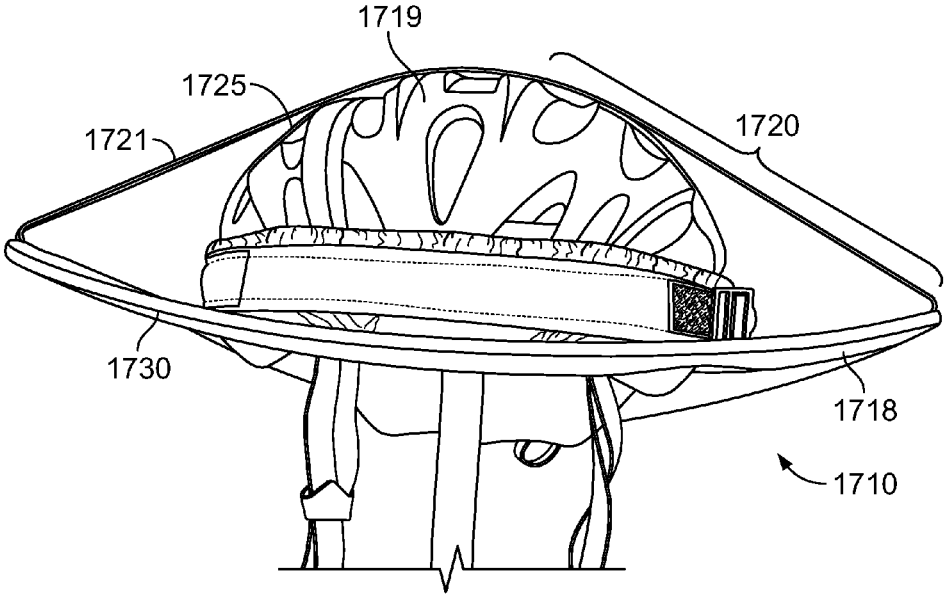
FIG. 24 is a front view of another headgear accessory attachment apparatus with an accessory attached to a helmet.
Figure 25:
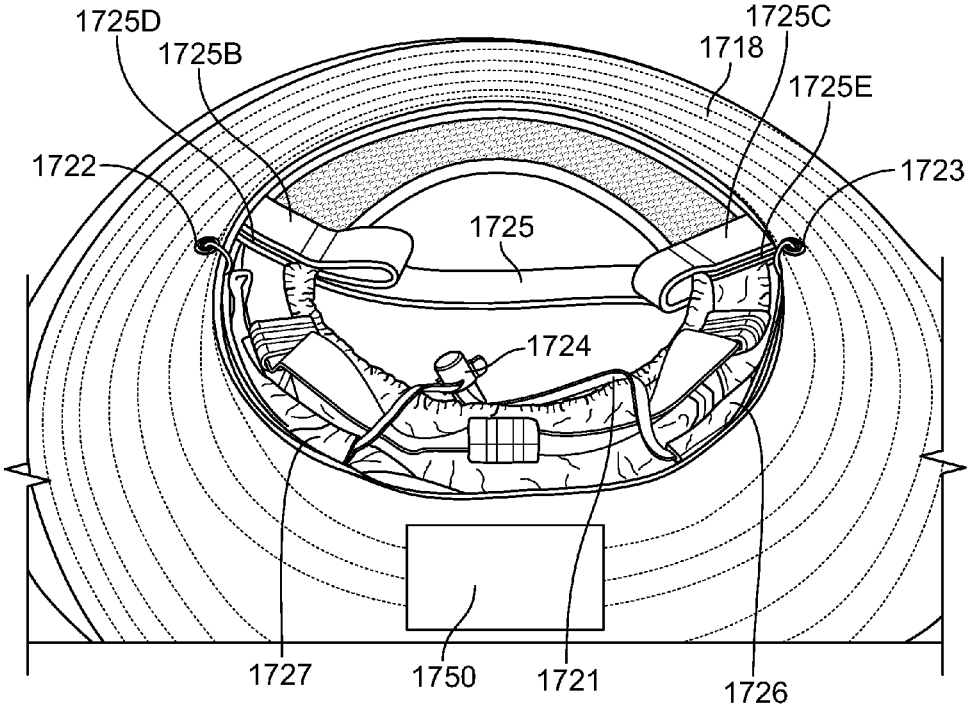
FIG. 25 is a partial perspective bottom view of the headgear accessory attachment apparatus with accessory of FIG. 24.

Some users of the apparatus may prefer to have a different style or look to a brim attached to the headgear attachment apparatus. In another embodiment of the headgear accessory attachment apparatus 1710 shown in FIGS. 24 and 25, a brim 1718 has been permanently attached to the apparatus by stitching. The brim 1718 could also be removably attached via mating hook and loop fasteners or other suitable devices. In this embodiment, a lateral adjustment feature 1720 comprises a string 1721, grommets 1722, 1723, and tightening device 1724. In the figure, the tightening device is pictured as a cordlock, although other types of devices including knots, ties, clamps, wedges, and other suitable devices can be used. The string runs from a top strap 1725 to the lateral edge of the brim through a grommet hole, through channels 1726, 1727 and back to a tightening device 1724. The top strap 1725 may have distal attachment devices, illustrated in FIG. 25 as hook fasteners, at its ends 1725B, 1725C. These top strap distal attachment devices may start as lengthy extensions that the user can cut to length so that the top strap fits the user's helmet. These top strap distal attachment devices can then be connected to a brim connection device 1725D, 1725E, which are illustrated as hook fasteners in FIG. 25. Although illustrated as hook and loop fasteners, distal attachment devices and brim connection devices may take many forms. Other examples of these devices include clips, loops, straps, buckles, snaps, magnets, and other suitable devices. In a method of using the device, the user installs the headgear accessory attachment apparatus 1710 with the attached brim 1718 to the headgear 1719 as described for the apparatus pictured in FIGS. 15-21. To adjust the position of the lateral edges of the brim, the user would pull on the string 1721 and secure the desired position of the lateral brim edge by engaging the tightening device at the appropriate point so as to constrict the length of the string 1721. In this way, the brim could look like a cowboy hat if preferred.

The apparatus may also have a stiffener that runs through a channel 1730 around the perimeter of the brim. The stiffener may be a flexible yet sturdy plastic rod. Wire, metal rods, or other suitable devices could be used. The stiffener is removable, foldable (or otherwise collapsible) and can be stored in a pocket 1750. The ability to remove the rod allows the brim to be structurally supported or stiff when traveling at speeds yet collapsible and packable for easy transport. The user would simply slide the stiffener into a channel 1730 on the edge of the brim when required or remove the stiffener and store when not needed It should be noted that while the embodiments disclosed above are described as being used with outdoor sports helmets, military helmets, and hard hats, the invention is not so limited, and can be used in conjunction with a variety of headgear.

It should also be noted that any of the preferred embodiments may be packaged with headgear to form a headgear system. In one embodiment a system includes a type of headgear such as, e.g., a bike helmet model Venture, manufactured by Easton Bell Sports, Inc. (Van Nuys, Calif., USA) and an accessory attachment apparatus as described herein. A system for bicycling may include a helmet, accessory attachment apparatus, and a headlamp. Helmet systems may also include a variety of accessories but not limited to those listed herein and may also include covers, nets, and/or clips.

The invention claimed is:

1. A helmet accessory attachment apparatus adapted to be secured to the helmet, the helmet accessory attachment apparatus comprising:

a band member comprising a central opening for receiving the helmet and at least one size adjustment member for adjusting the size of the flexible band member from a resting configuration, to an active configuration when the band member is fitted onto the helmet and the size adjustment feature is locked;

an accessory connector located on the band member for mounting a helmet accessory to the band member;

wherein the band member is sufficiently flexible to be manipulated from a floppy state in the resting configuration to a taut state in which the band member forms a secure clamp around a front edge of the helmet when the band member is fitted about the helmet and the size adjustment feature is locked, thereby prohibiting the apparatus from rising or rotating upwards on the helmet.

2. The helmet accessory attachment apparatus of claim 1 wherein the accessory connector is clip.

3. The helmet accessory attachment apparatus of claim 1 further comprising the helmet accessory.

4. The helmet accessory attachment apparatus of claim 3 wherein the helmet accessory is selected from the group consisting of a headlamp, goggle, night vision goggle, helmet camera, rear light, visor, brim, decorative embellishment, headphone, ear muff, ear plug, mosquito netting, and mirror.

5. A headgear system comprising:

an accessory attachment apparatus for attaching to the headgear, the headgear having a circumference, and a lower surface, the accessory attachment apparatus comprising:

a band member comprising a central opening for receiving the headgear and at least one size adjustment member for adjusting the size of the flexible band member from a resting configuration, to an active configuration when the band member is fitted onto the headgear and the size adjustment feature is locked;

an accessory connector located on the band member for mounting a headgear accessory to the band member;

wherein the band member is sufficiently flexible to be manipulated from a floppy state in the resting configuration to a taut state in which the band member forms a secure clamp around a front edge of the headgear when the band member is fitted about the headgear and the size adjustment feature is locked, thereby prohibiting the apparatus from rising or rotating upwards on the headgear.

6. The headgear system of claim 5 further comprising the headgear.

7. The headgear system of claim 6 wherein the headgear is a sports helmet.

8. The headgear system of claim 7 further comprising at least one lateral extension selected from the group consisting of a brim and a bill mountable to the accessory connector.

9. The headgear system of claim 5 wherein the accessory connector comprises an accessory first connector and an accessory second connector spaced from the first connector along the flexible band member.

10. The headgear system of claim 5 wherein said band comprises a first inner diameter (ID) at a first section and a second ID at a second section of the band member, and wherein the first section is below the second section, and wherein the first ID is less than the second ID.

11. The headgear system of claim 5 wherein the accessory connector is clip.

12. The headgear system of claim 5 further comprising the helmet accessory.

13. The headgear system of claim 12 wherein the helmet accessory is selected from the group consisting of a headlamp, goggle, night vision goggle, helmet camera, rear light, visor, brim, decorative embellishment, headphone, ear muff, ear plug, mosquito netting, and mirror.

* * * * *